US010821697B2

(12) United States Patent
Kodama et al.

(10) Patent No.: US 10,821,697 B2
(45) Date of Patent: Nov. 3, 2020

(54) CORRUGATED PAPERBOARD BOX MAKING MACHINE

(71) Applicant: KABUSHIKI KAISHA ISOWA, Nagoya-shi, Aichi (JP)

(72) Inventors: Junichi Kodama, Kasugai (JP); Yoshimichi Takahashi, Kasugai (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 384 days.

(21) Appl. No.: 15/835,044

(22) Filed: Dec. 7, 2017

(65) Prior Publication Data

US 2018/0178478 A1 Jun. 28, 2018

(30) Foreign Application Priority Data

Dec. 27, 2016 (JP) ..... 2016-254234
Dec. 27, 2016 (JP) ..... 2016-254235

(51) Int. Cl.

| | |
|---|---|
| ***B31B 50/20*** | (2017.01) |
| ***B26D 1/28*** | (2006.01) |
| ***B26D 3/06*** | (2006.01) |
| ***B31B 50/00*** | (2017.01) |
| ***B26D 5/00*** | (2006.01) |
| ***B26D 11/00*** | (2006.01) |
| ***B31B 50/14*** | (2017.01) |

(Continued)

(52) U.S. Cl.

CPC ..... *B31B 50/20* (2017.08); *B26D 1/28* (2013.01); *B26D 3/06* (2013.01); *B26D 5/00* (2013.01); *B26D 11/00* (2013.01); *B31B 50/006* (2017.08); *B31B 50/042* (2017.08); *B31B 50/146* (2017.08); *B31B 50/04* (2017.08); *B31B 2100/0022* (2017.08); *B31B 2110/35* (2017.08)

(58) Field of Classification Search

None

See application file for complete search history.

(56) References Cited

U.S. PATENT DOCUMENTS

2011/0092351 A1* 4/2011 Hatano ..... B31B 50/00 493/162
2018/0029244 A1* 2/2018 Yamamuro ..... B26D 1/40
2018/0370061 A1* 12/2018 Tokumo ..... B31B 50/18

FOREIGN PATENT DOCUMENTS

JP 2002-067190 A 3/2002
JP 2002067190 A * 3/2002

(Continued)

*Primary Examiner* — Hemant Desai
*Assistant Examiner* — Tanzim Imam
(74) *Attorney, Agent, or Firm* — Brinks Gilson & Lione

(57) ABSTRACT

Disclosed is a corrugated paperboard box making machine 1 in which a slotter device 6 comprises: a first slotter unit 61 comprising a first slotter 610, a first stationary blade 612 and a first displaceable blade 613; and a second slotter unit 62 comprising a second slotter 620, a second stationary blade 622 and a second displaceable blade 623. A control device 100 is operable to switch the slotter device 6 between a first production mode and a second production mode. Specifically, the control device 100 is operable, when implementing the second production mode, to acquire and store a total blade length of the first stationary blade 612 and the first displaceable blade 613 and a total blade length of the second stationary blade 622 and the second displaceable blade 623, and perform positioning control for the slotter blades, based on the stored total blade lengths.

17 Claims, 16 Drawing Sheets

(51) Int. Cl.

| | |
|---|---|
| ***B31B 50/04*** | (2017.01) |
| *B31B 100/00* | (2017.01) |
| *B31B 110/35* | (2017.01) |

(56) References Cited

FOREIGN PATENT DOCUMENTS

| | | | |
|---|---|---|---|
| JP | 2003-127251 | A | 5/2003 |
| JP | 2009-291992 | A | 12/2009 |
| JP | 2016-150407 | A | 8/2016 |

* cited by examiner

<Single Slotter Mode>

| | Current Register Value |
|---|---|
| First Stationary Blade | a |
| First Displaceable Blade | b |
| Second Stationary Blade | a |
| Second Displaceable Blade | b |

<Double Slotter Mode>

| | Current Register Value |
|---|---|
| First Stationary Blade | $a+b-\{(D \times \pi/2)-(f+g)\}$ |
| First Displaceable Blade | $D \times \pi-(f+g)$ |
| Second Stationary Blade | a |
| Second Displaceable Blade | $D \times \pi-(d+e)$ |

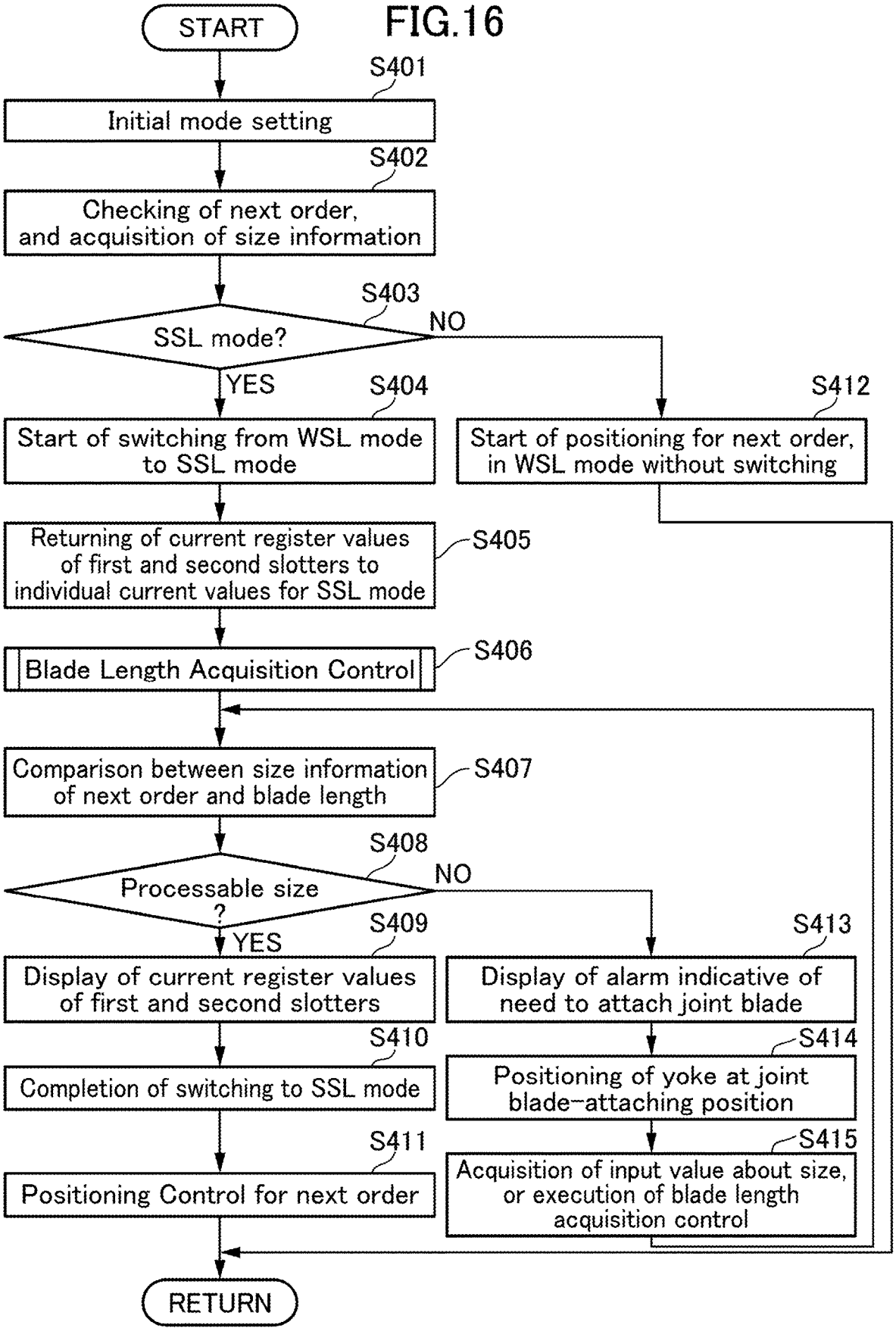
FIG.16
START
S401
Initial mode setting
S402
Checking of next order, and acquisition of size information
S403
SSL mode?
NO
YES
S404
Start of switching from WSL mode to SSL mode
S412
Start of positioning for next order, in WSL mode without switching
Returning of current register values of first and second slotters to individual current values for SSL mode
S405
Blade Length Acquisition Control
S406
Comparison between size information of next order and blade length
S407
S408
Processable size ?
NO
YES
S409
Display of current register values of first and second slotters
S413
Display of alarm indicative of need to attach joint blade
S410
Completion of switching to SSL mode
S414
Positioning of yoke at joint blade-attaching position
S411
Positioning Control for next order
S415
Acquisition of input value about size, or execution of blade length acquisition control
RETURN

CORRUGATED PAPERBOARD BOX MAKING MACHINE

RELATED APPLICATIONS

This application claims priority under 35 U.S.C. § 119 to Japanese Patent Application Nos. 2016-254234 and 2016-254235, both filed on Dec. 27, 2016, the entire content of which are hereby incorporated by reference.

BACKGROUND OF THE INVENTION

Field of the Invention

The present invention relates to a corrugated paperboard box making machine, and more particularly to a corrugated paperboard box making machine having a slotter device for performing slotting on a corrugated paperboard sheet.

Description of Related Art

Heretofore, there has been known a corrugated paperboard box making machine comprising a sheet feeding device for feeding out corrugated paperboard sheets one-by-one, a printing device for printing a pattern onto each of the corrugated paperboard sheets fed out by the sheet feeding device, and a slotter device for performing slotting (slot machining) on the corrugated paperboard sheets each having the pattern printed by printing device. Typically, this slotter device is configured to perform slotting on two zones, i.e., a downstream edge zone (corresponding to a top flap portion) and an upstream edge zone (corresponding to a bottom flap portion), of the corrugated paperboard sheet being conveyed.

For example, in the following Patent Document 1 (JP 2003-127251 A), there is disclosed a production method for use in a corrugated paperboard box making machine, which comprises, during a period in which a printing cylinder of a printing device is rotated 360 degrees, feeding two corrugated paperboard sheets each having a relatively small length in a conveyance direction, and performing processing with respect to the two corrugated paperboard sheets (This method will hereinafter be referred to as "two-up production").

This method is intended to enhance efficiency of box production in the corrugated paperboard box making machine. When performing the two-up production, it is necessary to print a given pattern onto each of a set of preceding and following corrugated paperboard sheets being fed successively, using two printing plates each wrappingly attached onto the printing cylinder, and then perform slotting on two zones, i.e., a top flap portion and a bottom flap portion, in each of the preceding and following corrugated paperboard sheets.

On the other hand, in the following Patent Document 2 (JP 2002-067190 A), there is disclosed a slotter device comprising two slotter units in each of which two slotter blades are provided on one rotary cylinder (upper slotter), wherein the two slotter units are arranged side-by-side along a conveyance direction of corrugated paperboard sheets.

BRIEF SUMMARY OF THE INVENTION

Technical Problem

The slotter device comprising two slotter units as described in the above Patent Document 2 is considered to be effective in performing slotting on successive preceding and following corrugated paperboard sheets, in the two-up production. Now, with reference to FIGS. 19A and 19B, discussion will be made about how to use such a slotter device comprising two slotter units each provided with two slotter blades.

FIGS. 19A and 19B are explanatory diagrams regarding two production modes in a slotter device 8 comprising first and second slotter units 81, 82. As depicted in FIGS. 19A and 19B, the first slotter unit 81 comprises: a first upper slotter 810 which is a rotary cylinder rotatably coupled to a rotary shaft (a first lower slotter is not depicted); a first stationary slotter blade 812 fixed onto an outer periphery of the first upper slotter 810, and equipped with a chisel (in other words, notching blade) 812*a* at an edge thereof on a leading side in a direction opposite to a rotational direction (which is a rotational direction of the first upper slotter 810 during processing of corrugated paperboard sheets, and a direction indicated by the arrowed line within the first upper slotter 810 in FIGS. 19A and 19B); and a first displaceable slotter blade 813 installed on the outer periphery of the first upper slotter 810 displaceably in a circumferential direction of the first upper slotter 810 and equipped with a chisel 813*a* at an edge thereof on a leading side in the rotational direction. On the other hand, the second slotter unit 82 is provided downstream of the first slotter unit 81 in a conveyance direction FD of corrugated paperboard sheets. As with the first slotter unit 81, the second slotter unit 82 comprises: a second upper slotter 820 which is a rotary cylinder rotatably coupled to a rotary shaft (a second lower slotter is not depicted); a second stationary slotter blade 822 fixed onto an outer periphery of the second upper slotter 820 and equipped with a chisel 822*a* at an edge thereof on a leading side in a direction opposite to a rotational direction of the second upper slotter 820; and a second displaceable slotter blade 823 installed on the outer periphery of the second upper slotter 820 displaceably in a circumferential direction of the second upper slotter 820 and equipped with a chisel 823*a* at an edge thereof on a leading side in the rotational direction.

FIG. 19A depicts a production mode configured to feed two corrugated paperboard sheets SH1, SH2 during a period in which each of the first and second upper slotters 810, 820 is rotated 360 degrees, and cause the first and second slotter units 81, 82 to perform slotting, respectively, on the two corrugated paperboard sheets SH2, SH1 (This production mode is performed to realize the two-up production, and will hereinafter be referred to appropriately as "single slotter mode"). In this single slotter mode, the first stationary slotter blade 812 and the first displaceable slotter blade 813 in the first slotter unit 81 are arranged on the outer periphery of the first upper slotter 810, while being spaced apart from each other by a given distance, and the second stationary slotter blade 822 and the second displaceable slotter blade 823 in the second slotter unit 82 are arranged on the outer periphery of the second upper slotter 820, while being spaced apart from each other by a given distance. Then, in the state in which the slotter blades are arranged in the above manner, the second stationary slotter blade 822 and the second displaceable slotter blade 823 of the second slotter unit 82 are operable to cut a slot, respectively, in a top flap portion and a bottom flap portion of the downstream-side corrugated paperboard sheet SH1, and the first stationary slotter blade 812 and the first displaceable slotter blade 813 of the first slotter unit 81 are operable to cut a slot, respectively, in a top flap portion and a bottom flap portion of the upstream-side corrugated paperboard sheet SH2.

On the other hand, FIG. 19B depicts a production mode configured to feed only one corrugated paperboard sheet SH during a period in which each of the first and second upper slotters 810, 820 is rotated 360 degrees, and cause both of the first and second slotter units 81, 82 to perform slotting on the one corrugated paperboard sheet SH (This production mode will hereinafter be referred to appropriately as "double slotter mode", and production employing the double slotter mode will hereinafter be referred to as "normal production" from the viewpoint of comparison with the above two-up production). In this double slotter mode, the first stationary slotter blade 812 and the first displaceable slotter blade 813 in the first slotter unit 81 are arranged on the outer periphery of the first upper slotter 810, while being in contact with each other, and the second stationary slotter blade 822 and the second displaceable slotter blade 823 in the second slotter unit 82 are arranged on the outer periphery of the second upper slotter 820, while being in contact with each other. That is, in the double slotter mode, one slotter blade assembly formed by integrating the first stationary slotter blade 812 and the first displaceable slotter blade 813 together is used, and one slotter blade assembly formed by integrating the second stationary slotter blade 822 and the second displaceable slotter blade 823 together is used. Then, in the state in which the slotter blades are arranged in the above manner, at least the second stationary slotter blade 822 of the second slotter unit 82 is operable to cut a slot in a top flap portion of the corrugated paperboard sheet SH, and at least the first displaceable slotter blade 813 of the first slotter unit 81 is operable to cut a slot in a bottom flap portion of the corrugated paperboard sheet SH. This double slotter mode is effective, for example, in producing a corrugated paperboard sheet having a relatively large length in the conveyance direction.

However, when the slotter device is run while switching between the single slotter mode and the double slotter mode, there is the following problem.

In both of the single slotter mode and the double slotter mode, in order to enable the first slotter unit 81 to perform slotting on a corrugated paperboard sheet, on the basis of a downward edge (leading edge) of the corrugated paperboard sheet, a parameter indicative of a relative position at which the chisel 812*a* of the first stationary slotter blade 812 is to be disposed with respect to the forward edge of the corrugated paperboard sheet (this parameter will hereinafter referred to appropriately as "current register value") is set, and then positioning control for the first stationary slotter blade 812 is performed using the set current register value. Similarly, in the second slotter unit 82, such a current register value is set with regard to the second stationary slotter blade 822, and then positioning control for the second stationary slotter blade 822 is performed using the set current register value.

Further, such a current register value is set with regard to each of the first and second displaceable slotter blades 813, 823. Specifically, with regard to the first displaceable slotter blade 813 of the first slotter unit 81, a current register value is set by a relative position of the chisel 813*a* of the first displaceable slotter blade 813 as derived on the basis of the chisel 812*a* of the first stationary slotter blade 812 (This relative position is equivalent to a circumferential length along the outer periphery of the first upper slotter 810). That is, a current register value indicative of a relative position at which the chisel 813*a* of the first displaceable slotter blade 813 is to be disposed with respect to the chisel 812*a* of the first stationary slotter blade 812 is set, and then positioning control for the first displaceable slotter blade 813 is performed using the set current register value. Similarly, in the second slotter unit 82, such a current register value is set with regard to the second displaceable slotter blade 823, and then positioning control for the second displaceable slotter blade 823 is performed using the set current register value.

As described above, in the single slotter mode, each of the first and second stationary slotter blades 812, 822 in the first and second slotter units 81, 82 operates to cut a slot in a respective one of top flap portions of two corrugated paperboard sheets, and each of the first and second displaceable slotter blades 813, 823 in the first and second slotter units 81, 82 operates to cut a slot in a respective one of bottom flap portions of the two corrugated paperboard sheets. Thus, each of the current register values of the first and second stationary slotter blades 812, 822 is set to a length dimension of a top flap of a corrugated paperboard sheet to be subjected to slotting, and each of the current register values of the first and second displaceable slotter blades 813, 823 is set to a box-depth dimension of the corrugated paperboard sheet to be subjected to slotting.

On the other hand, in the double slotter mode, the first displaceable slotter blade 813 in the first slotter unit 81 operates to cut a slot in a bottom flap portion of a corrugated paperboard sheet SH, and the second stationary slotter blade 822 in the second slotter unit 82 operates to cut a slot in a top flap portion of the corrugated paperboard sheet SH, as described above. Further, in the double slotter mode, the first stationary slotter blade 812 and the first displaceable slotter blade 813 are brought into contact with each other, and the second stationary slotter blade 822 and the second displaceable slotter blade 823 are brought into contact with each other. In the double slotter mode, each of the current register values of the first and second displaceable slotter blades 813, 823 is set to a circumferential length (specifically, a circumferential length along the direction opposite to the rotational direction of the first and second upper slotters 810, 820) from a corresponding one of the chisels 812*a*, 822*a* of the first and second stationary slotter blades 812, 822 to a corresponding one of the chisels 813*a*, 823*a* of the first and second displaceable slotter blades 813, 823, as described above. Thus, in the contact state of the slotter blades during the double slotter mode, a current register value of the first displaceable slotter blade 813 is set using a total blade length of the first stationary slotter blade 812 and the first displaceable slotter blade 813 along the circumferential direction, and a current register value of the second displaceable slotter blade 823 is set using a total blade length of the second stationary slotter blade 822 and the second displaceable slotter blade 823 along the circumferential direction. Specifically, the current register value of each of the first and second displaceable slotter blades 813, 823 is derived by subtracting the above total blade length from the circumference (entire circumferential length) of a corresponding one of the first and second upper slotters 810, 820 (In principle, each of the first and second upper slotters 810, 820 has the same entire circumferential length).

As above, for setting the current register value of each of the first and second displaceable slotter blades 813, 823 when implementing the double slotter mode, it is necessary to acquire, by the slotter device, a total blade length of the first stationary slotter blade 812 and the first displaceable slotter blade 813 in a state in which they are actually attached to the first slotter unit 81, and a total blade length of the second stationary slotter blade 822 and the second displaceable slotter blade 823 in a state in which they are actually attached to the second slotter unit 82. Unless the current register values of the first and second displaceable slotter blades 813, 823 are accurately set by acquiring the above total blade lengths, it is impossible to adequately perform the positioning control for the slotter blades in the double slotter mode.

It is therefore an object of the present invention to provide a corrugated paperboard box making machine which is equipped with a slotter device comprising two slotter units each having two slotter blades, and configured to be switchable between two production modes, wherein the corrugated paperboard box making machine is capable of adequately acquiring a total blade length of the two slotter blades to perform control.

Solution to Problem

In order to achieve the above object, the present invention provides a corrugated paperboard box making machine comprising a slotter device for performing slotting on a corrugated paperboard sheet, wherein the slotter device comprises a first slotter unit and a second slotter unit which is provided downstream of the first slotter unit in a conveyance direction of corrugated paperboard sheets, wherein: the first slotter unit comprising: a first slotter which is a rotary cylinder rotatably coupled to a rotary shaft; a first stationary slotter blade fixed onto an outer periphery of the first slotter; a first displaceable slotter blade installed on the outer periphery of the first slotter displaceably in a circumferential direction of the first slotter; a first phase adjustment mechanism for rotating the first slotter so as to adjust a rotational phase of the first slotter; and a first displacement adjustment mechanism for displacing the first displaceable slotter blade so as to adjust a relative position of the first displaceable slotter blade with respect to the first stationary slotter blade, on the outer periphery of the first slotter; and the second slotter unit comprising: a second slotter which is a rotary cylinder rotatably coupled to a rotary shaft; a second stationary slotter blade fixed onto an outer periphery of the second slotter; a second displaceable slotter blade installed on the outer periphery of the second slotter displaceably in a circumferential direction of the second slotter; a second phase adjustment mechanism for rotating the second slotter so as to adjust a rotational phase of the second slotter; and a second displacement adjustment mechanism for displacing the second displaceable slotter blade so as to adjust a relative position of the second displaceable slotter blade with respect to the second stationary slotter blade, on the outer periphery of the second slotter, and wherein the corrugated paperboard box making machine further comprises a control device configured to switchably implement a first production mode and a second production mode, wherein: the first production mode is configured to feed two corrugated paperboard sheets during one revolution of the first and second slotters, and cause the first and second slotter units to perform slotting, respectively, on the two corrugated paperboard sheets, in such a state that the first stationary slotter blade and the first displaceable slotter blade are spaced apart from each other by a given distance on the outer periphery of the first slotter, and that the second stationary slotter blade and the second displaceable slotter blade are spaced apart from each other by a given distance on the outer periphery of the second slotter; and the second production mode is configured to feed one corrugated paperboard sheet during one revolution of the first and second slotters, and to cause both of the first and second slotter units to perform slotting on the one corrugated paperboard sheet, in such a state that the first stationary slotter blade and the first displaceable slotter blade are in contact with each other on the outer periphery of the first slotter, and that the second stationary slotter blade and the second displaceable slotter blade are in contact with each other on the outer periphery of the second slotter, and wherein the control device is configured: to acquire a first total blade length of the first stationary slotter blade and the first displaceable slotter blade along the circumferential direction of the first slotter, and a second total blade length of the second stationary slotter blade and the second displaceable slotter blade along the circumferential direction of the second slotter, so as to store the acquired first and second total blade lengths when implementing the second production mode; and to perform positioning control for a set of the first stationary slotter blade and the first displaceable slotter blade being in a contact state by using the first phase adjustment mechanism, and perform positioning control for a set of the second stationary slotter blade and the second displaceable slotter blade being in a contact state by using the second phase adjustment mechanism, based on the stored first and second total blade lengths, in order to implement the second production mode.

In the corrugated paperboard box making machine of the present invention having the above feature, the use of the first and second total blade lengths makes it possible to adequately set the set of the first stationary slotter blade and the first displaceable slotter blade, and the set of the second stationary slotter blade and the second displaceable slotter blade, at appropriate positions for the second production mode. In addition, in the corrugated paperboard box making machine of the present invention, it is possible to adequately perform the positioning in the second production mode. This makes it possible to automatically perform switching from the first production mode to the second production mode.

Preferably, in the corrugated paperboard box making machine of the present invention, the control device is configured: to cause the first displacement adjustment mechanism to displace the first displaceable slotter blade toward the first stationary slotter blade, from a state in which the first stationary slotter blade and the first displaceable slotter blade are disposed, respectively, at first and second reference positions spaced apart from each other on the outer periphery of the first slotter, so as to derive the first total blade length based on an amount by which the first displaceable slotter blade is displaced before it is brought into contact with the first stationary slotter blade; and to cause the second displacement adjustment mechanism to displace the second displaceable slotter blade toward the second stationary slotter blade, from a state in which the second stationary slotter blade and the second displaceable slotter blade are disposed, respectively, at third and fourth reference positions spaced apart from each other on the outer periphery of the second slotter, so as to derive the second total blade length based on an amount by which the second displaceable slotter blade is displaced before it is brought into contact with the second stationary slotter blade.

According to this feature, it is possible to automatically derive accurate values of the first and second total blade lengths. In addition, it is possible to derive the first total blade length in a state in which the first stationary slotter blade and the first displaceable slotter blade are actually in contact with each other, and derive the second total blade length in a state in which the second stationary slotter blade and the second displaceable slotter blade are actually in contact with each other. Thus, even in a situation where there is a slight gap between the first stationary slotter blade and the first displaceable slotter blade in the contact state, or there is a slight gap between the second stationary slotter blade and the second displaceable slotter blade in the contact state, it is possible to accurately derive the total blade length while taking into account such a gap.

Preferably, in the above corrugated paperboard box making machine, the control device is configured: to acquire a torque given from the first displacement adjustment mechanism to displace the first displaceable slotter blade, so as to determine whether or not the first displaceable slotter blade is brought into contact with the first stationary slotter blade, based on the acquired torque; and to acquire a torque given from the second displacement adjustment mechanism to displace the second displaceable slotter blade, so as to determine whether or not the second displaceable slotter blade is brought into contact with the second stationary slotter blade, based on the acquired torque.

According to this feature, when deriving the first and second total blade lengths, it is possible to detect an accurate contact state of the slotter blades.

Preferably, in the above corrugated paperboard box making machine, the first and second reference positions are defined in a lower region of a circumference of the cylinder of the first slotter, and the third and fourth reference positions are defined in a lower region of a circumference of the cylinder of the second slotter.

According to this feature, it is possible to prevent occurrence of defective contact between the slotter blades or damage to the displacement adjustment mechanism for displacing the slotter blade, which would otherwise be caused by foreign particles, such as paper fragment or paper powder, pinched between the slotter blades during the course of bringing the slotter blades into contact with each other to derive the total blade length.

Preferably, the corrugated paperboard box making machine of the present invention further comprises a first position sensor for detecting respective positions of the first stationary slotter blade and the first displaceable slotter blade on the outer periphery of the first slotter, and a second position sensor for detecting respective positions of the second stationary slotter blade and the second displaceable slotter blade on the outer periphery of the second slotter, wherein the control device is configured to derive the first total blade length based on a detection signal of the first position sensor, and to derive the second total blade length based on a detection signal of the second position sensor.

According to this feature, the use of the position sensors makes is possible to automatically derive accurate values of the first and second total blade lengths.

Preferably, in the above corrugated paperboard box making machine, the control device is further configured, when implementing the first production mode, to derive respective blade lengths of the first stationary slotter blade and the first displaceable slotter blade based on the detection signal of the first position sensor, and to derive respective blade lengths of the second stationary slotter blade and the second displaceable slotter blade based on the detection signal of the second position sensor.

According to this feature, it is possible to accurately derive the blade length of each of the slotter blades individually. Therefore, for example, when switching from the second production mode to the first production mode, it is possible to adequately implement this first production mode.

Preferably, in the corrugated paperboard box making machine of the present invention, the control device is configured to acquire a blade length pattern of a slotter blade employed in the slotter device, so as to derive a blade length of the slotter blade based on the acquired blade length pattern.

According to this feature, the use of the blade length pattern makes it possible to accurately derive the blade length in a quick manner.

Preferably, in the corrugated paperboard box making machine of the present invention, the control device is configured to acquire and store the first and second total blade lengths which are input by an operator.

According to this feature, it is possible to utilize data about the total blade lengths input by an operator, directly, i.e., without any calculation.

Preferably, in the corrugated paperboard box making machine of the present invention, the control device is configured, when implementing the second production mode, to control the first displacement adjustment mechanism to displace the first displaceable slotter blade so that the first stationary slotter blade and the first displaceable slotter blade are brought into contact with each other in a lower region of a circumference of the cylinder of the first slotter, and to control the second displacement adjustment mechanism to displace the second displaceable slotter blade so that the second stationary slotter blade and the second displaceable slotter blade are brought into contact with each other in a lower region of a circumference of the cylinder of the second slotter.

According to this feature, it is possible to prevent occurrence of defective contact between the slotter blades or damage to the displacement adjustment mechanism for displacing the slotter blade, which would otherwise be caused by foreign particles, such as paper fragment or paper powder, pinched between the slotter blades during the course of bringing the slotter blades into contact with each other.

Preferably, in the corrugated paperboard box making machine of the present invention, the first stationary slotter blade is equipped with a chisel (in other words, notching blade) at an edge thereof on a leading side in a direction opposite to a rotational direction of the first slotter during processing of corrugated paperboard sheets, the first displaceable slotter blade is equipped with a chisel at an edge thereof on a leading side in the rotational direction of the first slotter during the processing of corrugated paperboard sheets, the second stationary slotter blade is equipped with a chisel at an edge thereof on a leading side in a direction opposite to a rotational direction of the second slotter during the processing of corrugated paperboard sheets, the second displaceable slotter blade is equipped with a chisel at an edge thereof on a leading side in the rotational direction of the second slotter during the processing of corrugated paperboard sheets, the corrugated paperboard box making machine further comprises a display device for displaying given information based on control of the control device, the control device is configured: to perform positioning control for the first stationary slotter blade by using a first positioning parameter indicative of a relative position at which the chisel of the first stationary slotter blade of the first slotter unit is to be disposed with respect to an downstream edge of the corrugated paperboard sheet, in order to cause the first slotter unit to perform slotting on the corrugated paperboard sheet; and to perform positioning control for the second stationary slotter blade by using a second positioning parameter indicative of a relative position at which the chisel of the second stationary slotter blade of the second slotter unit is to be disposed with respect to an downstream edge of the corrugated paperboard sheet, in order to cause the second slotter unit to perform slotting on the corrugated paperboard sheet; and, when implementing the second production mode, the control device is configured: with regard to the second positioning parameter, to cause the display device to directly display a value corresponding to the said second positioning parameter; and with regard to the first positioning parameter, to correct a value corresponding to the said first positioning parameter into a value corresponding to a size of the corrugated paperboard sheet, so as to cause the display device to display the corrected value.

According to this feature, in the second production mode, a value corresponding to a processing size of a corrugated paperboard sheet is displayed as information regarding each of the first and second positioning parameters. This enables an operator to easily perform various adjustments of the slotter device, under understanding of a relationship between the displayed value and the processing size of the corrugated paperboard sheet.

Preferably, in the above corrugated paperboard box making machine, the control device is configured to correct the first positioning parameter based on the first total blade length of the first stationary slotter blade and the first displaceable slotter blade along the circumferential direction of the first slotter.

According to this feature, it is possible to adequately correct a value to be displayed correspondingly to the first positioning parameter, based on the first total blade length of the first stationary slotter blade and the first displaceable slotter blade.

Preferably, in the above corrugated paperboard box making machine, the control device is configured, when switching from the first production mode to the second production mode, to acquire and store the first total blade length, and to correct the first positioning parameter based on the stored first total blade length.

According to this feature, it is possible to automatically perform the correction of the first positioning parameter based on the first total blade length.

Preferably, in the above corrugated paperboard box making machine, the control device is configured to correct the first positioning parameter by adding, to the value corresponding to the first positioning parameter, a value derived from the following formula: $[(D\times\pi/2)-(f+g)]$, where: "D" denotes a diameter of the first slotter; "f" denotes a blade length of the first stationary slotter blade; and "g" denotes a blade length of the first displaceable slotter blade.

According to this feature, it is possible to easily perform the correction of the first positioning parameter, using the calculation formula.

Preferably, in the above corrugated paperboard box making machine, the control device is configured to cause the display device to display a value of (a+b), as a corrected value of the value corresponding to the first positioning parameter, where "a" and "b" denote, respectively, a length of a top flap and a box depth of the corrugated paperboard sheet.

According to this feature, it is possible to enable an operator to reliably understand a relationship between the displayed value regarding the first positioning parameter and the processing size of the corrugated paperboard sheet.

Alternatively the control device may be configured to cause the display device to display a value of "b", as a corrected value of the value corresponding to the first positioning parameter, where "a" and "b" denote, respectively, a length of a top flap and a box depth of the corrugated paperboard sheet.

According to this feature, it is also possible to enable an operator to reliably understand the relationship between the displayed value regarding the first positioning parameter and the processing size of the corrugated paperboard sheet.

Preferably, in the above corrugated paperboard box making machine, the control device is further configured to perform positioning control for the first displaceable slotter blade by using a third positioning parameter indicative of a relative position at which the chisel of the first displaceable slotter blade of the first slotter unit is to be disposed with respect to the chisel of the first stationary slotter blade, and to perform positioning control for the second displaceable slotter blade by using a fourth positioning parameter indicative of a relative position at which the chisel of the second displaceable slotter blade of the second slotter unit is to be disposed with respect to the chisel of the second stationary slotter blade.

According to this feature, it becomes possible to adequately perform the positioning control for the first and second displaceable slotter blades based on the third and fourth positioning parameters, respectively.

Preferably, in the corrugated paperboard box making machine of the present invention, the first stationary slotter blade is equipped with a chisel at an edge thereof on a leading side in a direction opposite to a rotational direction of the first slotter during processing of corrugated paperboard sheets, the first displaceable slotter blade is equipped with a chisel at an edge thereof on a leading side in the rotational direction of the first slotter during the processing of corrugated paperboard sheets, the second stationary slotter blade is equipped with a chisel at an edge thereof on a leading side in a direction opposite to a rotational direction of the second slotter during the processing of corrugated paperboard sheets, the second displaceable slotter blade is equipped with a chisel at an edge thereof on a leading side in the rotational direction of the second slotter during the processing of corrugated paperboard sheets, the control device is configured: to perform positioning control for the first stationary slotter blade by using a first positioning parameter indicative of a relative position at which the chisel of the first stationary slotter blade of the first slotter unit is to be disposed with respect to an downstream edge of the corrugated paperboard sheet, in order to cause the first slotter unit to perform slotting on the corrugated paperboard sheet; and to perform positioning control for the second stationary slotter blade by using a second positioning parameter indicative of a relative position at which the chisel of the second stationary slotter blade of the second slotter unit is to be disposed with respect to an downstream edge of the corrugated paperboard sheet, in order to cause the second slotter unit to perform slotting on the corrugated paperboard sheet; and, when implementing the second production mode, the control device is configured: with regard to the second positioning parameter, to directly use a value corresponding to a size of the corrugated paperboard sheet; and with regard to the first positioning parameter, to use a value obtained by correcting the value corresponding to the size of the corrugated paperboard sheet.

According to this feature, it is possible to adequately perform the positioning control for the slotter blades, in the second production mode.

BRIEF DESCRIPTION OF THE SEVERAL VIEWS OF THE DRAWINGS

FIG. 16 is a flowchart presenting control for switching from the double slotter mode to the single slotter mode, in this embodiment.

DETAILED DESCRIPTION OF THE INVENTION

With reference to the accompanying drawings, a corrugated paperboard box making machine of the present invention will now be described based on one embodiment thereof.

<Corrugated Paperboard Box Making Machine>

First of all, with reference to FIG. 1, a general configuration of a corrugated paperboard box making machine 1 according to one embodiment of the present invention will be described.

Figure 1:
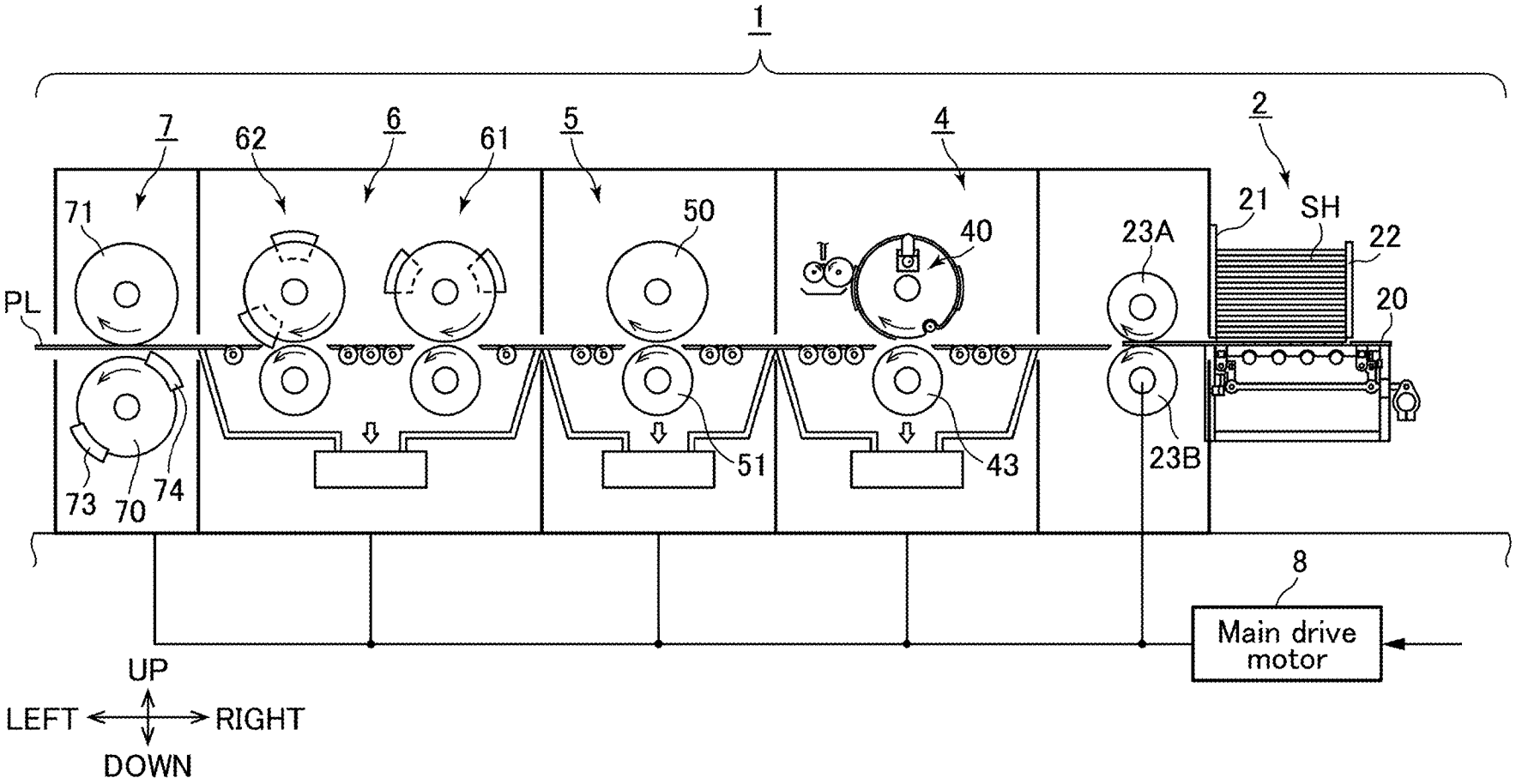
FIG. 1 is a front view depicting a general configuration of a corrugated paperboard box making machine according to one embodiment of the present invention.

FIG. 1 is a front view depicting the general configuration of the corrugated paperboard box making machine 1 according to this embodiment. The corrugated paperboard sheet box making machine 1 comprises; a sheet feeding device 2 for feeding out one-by-one a stack of the corrugated paperboard sheets SH stacked in an upward-downward direction; a printing device 4 for printing a pattern onto the corrugated paperboard sheet SH; a creaser device 5 for forming a crease line in the corrugated paperboard sheet SH; a slotter device 6 for performing slotting (slot machining) on the corrugated paperboard sheet SH; and a die-cutter device 7 for performing punching on the corrugated paperboard sheet SH, which are arranged in this order from the side of an upstream end of a conveyance path PL of a fed corrugated paperboard sheet SH (a conveyance direction of the corrugated paperboard sheet SH is a direction oriented from right to left in FIG. 1).

The sheet feeding device 2 comprises a table 20, a front gate 21 and a back guide 22, wherein a large number of the corrugated paperboard sheets SH are stacked on the table in a space between the front gate 21 and the back guide 22. The sheet feeding device 2 further comprises a large number of sheet feeding rollers, a liftable-lowerable grate, and a pair of feed rolls 23A, 23B. When the grate is lowered with respect to the large number of sheet feeding rollers, the large number of sheet feeding rollers are brought into contact with a lowermost one of the stack of corrugated paperboard sheets SH, and sequentially feed out the lowermost corrugated paperboard sheet SH toward the feed rolls 23A, 23B. The feed rolls 23A, 23B are driven by a main drive motor 8.

The printing device 4 comprises: a printing cylinder 40, so-called "impression cylinder"; a press roll 43 disposed at a position opposed to the printing cylinder 4 across the conveyance path PL; a printing plate member for printing a pattern on the corrugated paperboard sheet SH; and an ink applicator for supplying ink to the printing plate member. The printing cylinder 40 and the press roll 43 are driven by the main drive motor 8.

The creaser device 5 comprises an upper creasing roll 50 and a lower creasing roll 51 which are disposed across the conveyance path PL. The upper and lower ceasing rolls 50, 51 are operable to form a crease line in the corrugated paperboard sheet SH being conveyed, at a desired position. The upper and lower ceasing rolls 50, 51 are driven by the main drive motor 8.

The slotter device 6 comprises two slotter units 61, 62. Each of the slotter units 61, 62 comprises; an upper slotter to which two slotter blades are attached; and a lower slotter formed with a groove capable of fittingly receiving the slotter blades therein. The upper and lower slotters are operable to cut a slot in a desired position of the corrugated paperboard sheet SH being conveyed. The upper and lower slotters are driven by the main drive motor 8.

The die-cutter device 7 comprises a die cylinder 70 and an anvil cylinder 71 which are disposed across the conveyance path PL. A pair of punching dies 73, 74 each for punching the corrugated paperboard sheet SH is attached to a plate-shaped member such as a veneer board, and then the plate-shaped member is wrappingly attached to an outer peripheral surface of the die cylinder 70. Each of the punching dies 73, 74 is operable to punch out part of the corrugated paperboard sheet SH being continuously conveyed, at a desired position. The die cylinder 70 and the anvil cylinder 71 are driven by the main drive motor 8.

<Slotter Device>

Figure 2:
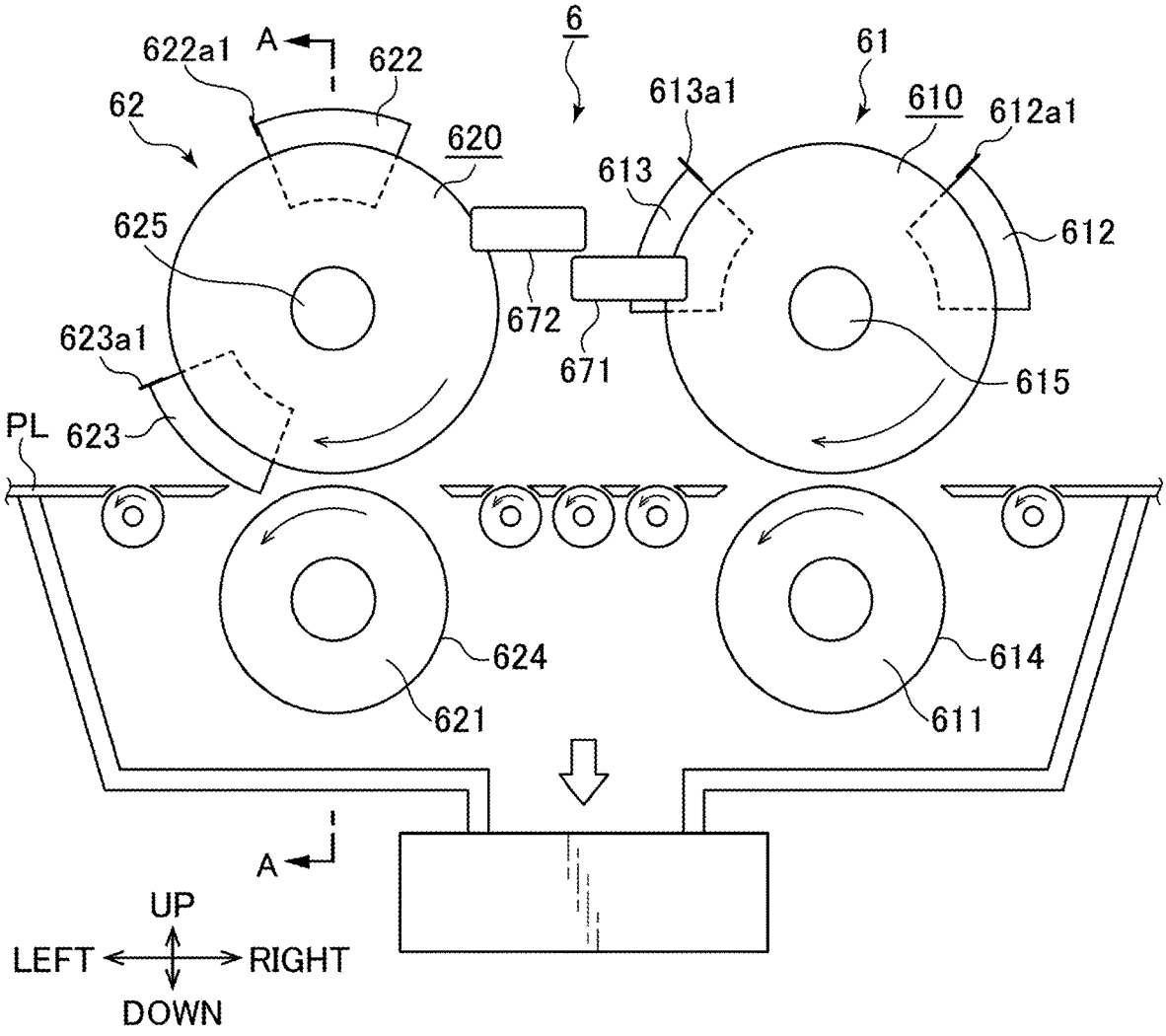
FIG. 2 is a front view enlargedly depicting a detailed configuration of first and second slotter units of a slotter device in this embodiment.
Figure 3:
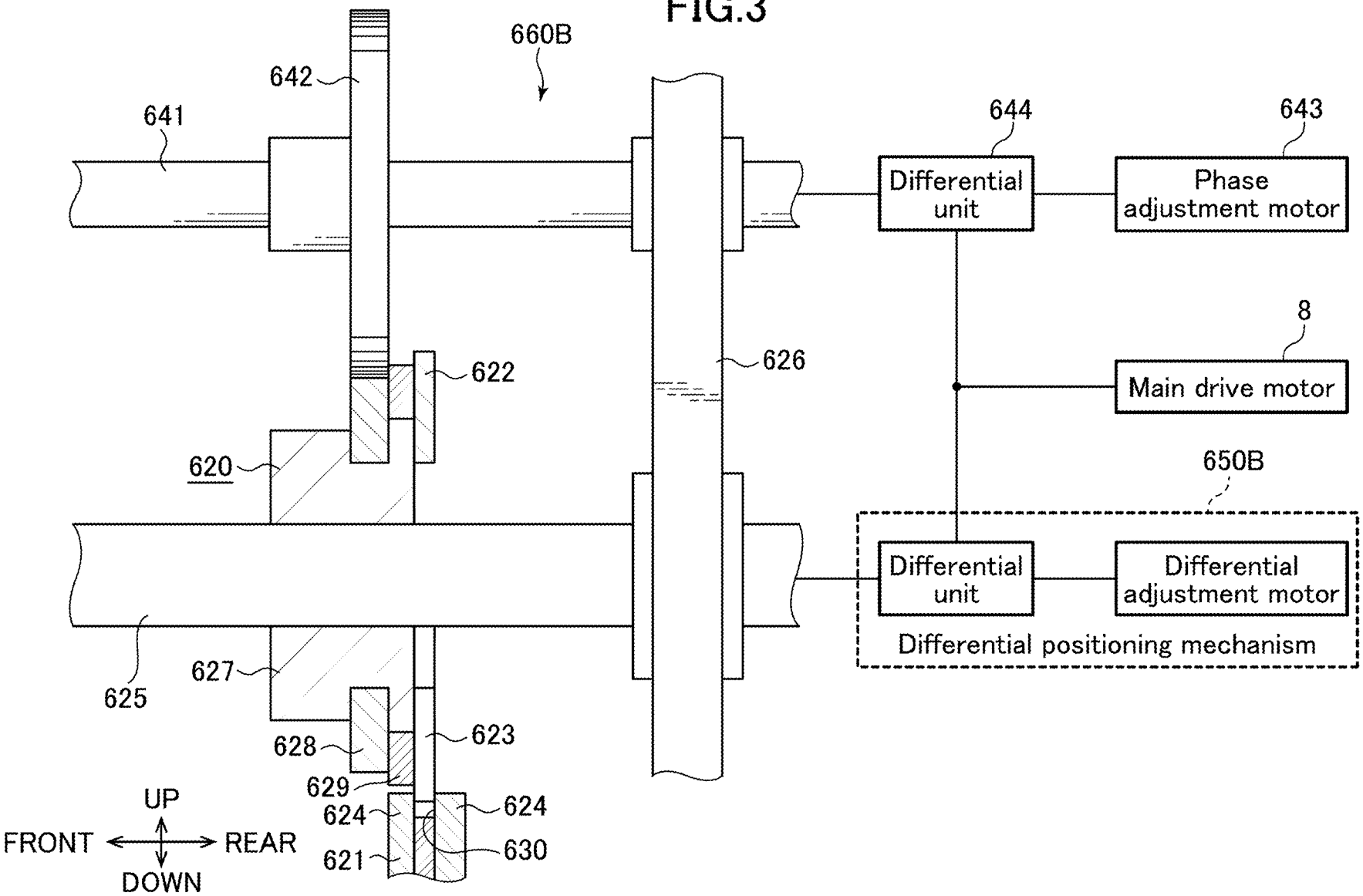
FIG. 3 is a partially sectional side view depicting the second slotter unit of the slotter device in this embodiment.

With reference to FIGS. 2 and 3, a specific configuration of the slotter device 6 according to this embodiment will be described. FIG. 2 is a front view enlargedly depicting a detailed configuration of the first and second slotter units 61, 62 of the slotter device 6 in this embodiment, and FIG. 3 is a partially sectional side view depicting the second slotter unit 62 of the slotter device 6 in this embodiment.

(Configuration of Slotter Device)

In FIG. 2, the slotter device 6 comprises the first slotter unit 61 and the second slotter unit 62 which are disposed, respectively, on an upstream side and on a downstream side along the conveyance path PL. The first slotter unit 61 comprises: a slotting slotter set composed of a first upper slotter 610 and a first lower slotter 611 arranged across the conveyance path PL, and provided, e.g., by a number of three, in a direction orthogonal to the conveyance path PL; and a heretofore-known joint flap-forming slotter set provided, e.g., by a number of one, in the orthogonal direction. Each of the slotters 610, 611 is coupled to the main drive motor 8 via a heretofore-known power transmission mechanism, and configured to be rotated in a direction indicated by the arrowed line in FIG. 2, according to rotation of the main drive motor 8. The second slotter unit 62 comprises: a slotting slotter set composed of a second upper slotter 620 and a second lower slotter 621 arranged across the conveyance path PL, and provided, e.g., by a number of three, in a direction orthogonal to the conveyance path PL (in a forward-rearward direction in FIG. 3); and a heretofore-known joint flap-forming slotter set provided, e.g., by a number of one, in the orthogonal direction. Each of the slotters 620, 621 is coupled to the main drive motor 8 via a heretofore-known power transmission mechanism, and configured to be rotated in a direction indicated by the arrowed line in FIG. 2, according to rotation of the main drive motor 8.

The first upper slotter 610 is provided with: a first stationary slotter blade 612 which is fixed onto an outer periphery of the first upper slotter 610, and equipped with a chisel 612*a*1 at an edge thereof on a leading side in a direction opposite to a rotational direction of the first upper slotter 610; and a first displaceable slotter blade 613 which is installed on the outer periphery of the first upper slotter 610 displaceably in a circumferential direction of the first upper slotter 610, and equipped with a chisel 613*a*1 at an edge thereof on a leading side in the rotational direction. The first lower slotter 611 is rotatably supported by a frame of the slotter device 6, and configured such that it has an outer periphery entirely formed as a first slotter blade 614. The first upper slotter 610 is rotatably supported by the frame of the slotter device 6 through a first slotter shaft 615. The second upper slotter 620 is provided with: a second stationary slotter blade 622 which is fixed onto an outer periphery of the second upper slotter 620, and equipped with a chisel 622*a*1 at an edge thereof on a leading side in a direction opposite to a rotational direction of the second upper slotter 620; and a second displaceable slotter blade 623 which is installed on the outer periphery of the first upper slotter 620 displaceably in a circumferential direction of the second upper slotter 620, and equipped with a chisel 623*a*1 at an edge thereof on a leading side in the rotational direction. The second lower slotter 621 is rotatably supported by the frame of the slotter device 6, and configured such that it has an outer periphery entirely formed as a second slotter blade 624. The second upper slotter 620 is rotatably supported by the frame of the slotter device 6 through a second slotter shaft 625.

Two position sensors 671, 672 are provided between the first slotter unit 61 and the second slotter unit 62. The position sensors 671, 672 are arranged staggeredly in the upward-downward direction, and fixed to the frame of the slotter device 6. The position sensor 671 is configured to be capable of detecting the first stationary slotter blade 612 and the first displaceable slotter blade 613, and the position sensor 672 is configured to be capable of detecting the second stationary slotter blade 622 and the second displaceable slotter blade 623. Specifically, the position sensor 671 is configured to be turned on when the first stationary slotter blade 612 or the first displaceable slotter blade 613 is located adjacent to the position sensor 671, and the position sensor 672 is configured to be turned on when the second stationary slotter blade 622 or the second displaceable slotter blade 623 is located adjacent to the position sensor 672. For example, a proximity sensor capable of detecting metal is employed as each of the position sensors 671, 672.

In the following description, the term "stationary slotter blade" will be occasionally expressed as "stationary blade", and the term "displaceable slotter blade" will be occasionally expressed as "displaceable blade". Further, when there is a need to describe the first stationary blade 612 or the second stationary blade 622 without discriminating them, each of the elements will be occasionally expressed as "the stationary blade" generically and simply, and, when there is a need to describe the first displaceable blade 613 or the second displaceable blade 623 without discriminating them, each of the elements will be occasionally expressed as "the displaceable blade" generically and simply. Furthermore, when there is a need to use the terms "stationary blade" and "displaceable blade" without discriminating them, the terms will be occasionally expressed generically and simply as "slotter blade".

(Configuration of Slotter Unit)

The first and second slotter units 61, 62 have the same configuration. Therefore, as a representative example, only the second slotter unit 62 will be described with reference to FIG. 3. FIG. 3 includes a sectional view of the second upper slotter 620 of the second slotter unit 62, taken along the line A-A in FIG. 2. In FIG. 3, the second slotter shaft 625 is composed of a spline shaft, and rotatably supported by the frame 626 through a bearing. The second slotter shaft 625 is coupled to the main drive motor 8 via a differential positioning mechanism 650B. Generally, the differential positioning mechanism 650B comprises a differential unit composed of a harmonic drive (registered trademark), and a differential adjustment motor. The harmonic drive (registered trademark) comprises a wave generator, a flexspline, and a circular spline. In this embodiment, the second slotter shaft 625 is coupled to flexspline, and a transmission member to which motive power is transmitted from the main drive motor 8 is coupled to the circular spline. The differential adjustment motor of a heretofore-known type composed of a servomotor is coupled to the wave generator. The differential adjustment motor is rotationally driven to thereby adjust a rotational phase of each slotter shaft with respect to the transmission member to which motive power is transmitted from the main drive motor 8.

While, in the above example, the differential positioning mechanism 650B used in the second slotter unit 62 has been shown, it should be noted that a differential positioning mechanism having the same configuration as that is also used in the first slotter unit 61. In the following description, for the sake of explanation, the differential positioning mechanism used in the first slotter unit 61 is assigned with the reference sign "650A". This differential positioning mechanism 650A is coupled to the first slotter shaft 615 and the main drive motor 8. The differential positioning mechanism 650A and the differential positioning mechanism 650B are equivalent, respectively, to "first phase adjustment mechanism" and "second phase adjustment mechanism" set forth in the appended claims.

The second upper slotter 620 comprises a slotter holder 627, a rotary gear 628 having a gear formed on an outer periphery part thereof, and a rotary ring 629, in addition to the second stationary blade 622 and the second displaceable blade 623. The slotter holder 627 is supported by the slotter shaft 625 slidably in an axial direction of the slotter shaft 625, in such a manner as to change a position of slotting to be performed on a leading edge zone and a trailing edge zone of the corrugated paperboard sheet SH. The rotary gear 628 and the rotary ring 629 are rotatably supported by the slotter holder 627, and coupled to each other in an integrally rotatable manner. The second displaceable blade 623 is fixed to the rotary ring 629, and the second stationary blade 622 is directly fixed to the slotter holder 627.

The second lower slotter 621 is supported by a spline shaft, in such a manner as to be slid in the forward-rearward direction in FIG. 3, interlockingly with the second upper slotter 620 being slid on the slotter shaft 625 through the slotter holder 627. The second lower slotter 621 has a fitting groove 630 in a central region of an outer periphery thereof in the forward-rearward direction. The fitting groove 630 is provided over the entire circumferential region of the second lower slotter 621, and formed to allow respective distal edges of the second stationary blade 622 and the second displaceable blade 623 to be fittingly inserted thereinto.

(Displaceable Blade Displacement Adjustment Mechanism)

In this embodiment, in order to adjust a rotational phase of the second displaceable blade 623 with respect to the second stationary blade 622, a displaceable blade displacement adjustment mechanism 660B is provided in the second slotter unit 62. The displaceable blade displacement adjustment mechanism 660B comprises an adjustment shaft 641 extending parallel to the slotter shaft 625, a transmission gear 642, a phase adjustment motor 643, and a differential unit 644. The adjustment shaft 641 is composed of a spline shaft, and coupled to the phase adjustment motor 643 through a differential unit 644 such as a heretofore-known harmonic drive (registered trademark), while being rotatably supported by the frame 626 through a bearing. Specifically, a transmission shaft to which motive power is transmitted from the phase adjustment drive motor 643 is coupled to a wave generator of the harmonic drive (registered trademark), and the adjustment shaft 641 is coupled to a flexspline of the harmonic drive (registered trademark). A transmission member to which motive power is transmitted from the main drive motor 8 is coupled to a circular spline of the harmonic drive (registered trademark). The transmission gear 642 is supported by the adjustment shaft 641, in such a manner as to be slid along the adjustment shaft 641, interlockingly with the second upper slotter 620 being slid on the slotter shaft 625 through the slotter holder 627. The transmission gear 642 is meshed with the rotary gear 628 to transmit rotation of the adjustment shaft 641 to the rotary gear 628. When the phase adjustment motor 643 is rotationally driven during a period in which the main drive motor 8 is stopped, rotation of the phase adjustment motor 643 is reduced by the harmonic drive (registered trademark) which is the differential unit 644, and then transmitted to the second displaceable blade 623 via the transmission gear 642, the rotary gear 628 and the rotary ring 629, so that the second displaceable blade 623 is displaced along an outer peripheral surface the slotter holder 627. In this way, the rotational phase of the second displaceable blade 623 with respect to the second stationary blade 622 is adjusted. On the other hand, when the main drive motor 8 is rotationally driven to rotate the slotter shaft 625, during a period in which the phase adjustment motor 643 is braked and stopped, rotation of the main drive motor 8 is transmitted to the adjustment shaft 641 via the differential unit 644. Thus, the adjustment shaft 641 is rotated to thereby enable the second displaceable blade 623 to be rotated together with the slotter holder 627 while maintaining a constant positional relationship with the second stationary blade 622.

While, in the above example, the displaceable blade displacement adjustment mechanism 660B used in the second slotter unit 62 has been shown, it should be noted that a displaceable blade displacement adjustment mechanism having the same configuration as that is also used in the first slotter unit 61. In the following description, for the sake of explanation, the displaceable blade displacement adjustment mechanism used in the first slotter unit 61 is assigned with the reference sign "660A". The displaceable blade displacement adjustment mechanism 660A and the displaceable blade displacement adjustment mechanism 660B are equivalent, respectively, to "first displacement adjustment mechanism" and "second displacement adjustment mechanism" set forth in the appended claims.

<Control Device>

Figure 4:
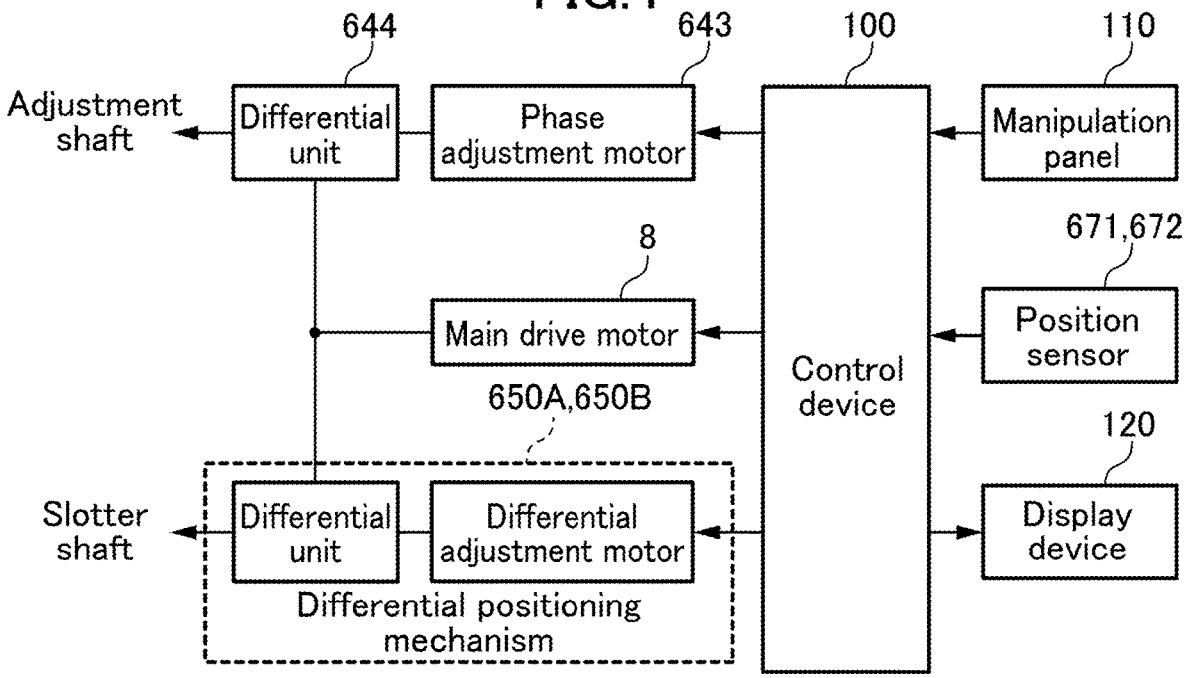
FIG. 4 is a block diagram depicting an electrical configuration of a control device in this embodiment.

Next, with reference to FIG. 4, a control device 100 in this embodiment will be described. FIG. 4 is a block diagram depicting an electrical configuration of the control device 100 in this embodiment. Although FIG. 4 mainly depicts a control configuration for the slotter device 6 by the control unit 100, this control unit 100 is operable to perform control for various components (the sheet feeding device 2, the printing device 4, the creaser device 5, the die-cutter device 7 and others) of the corrugated paperboard box making machine 1, in addition to the slotter device 6.

Basically, the control device 100 is operable to control the main drive motor 8 to selectively rotate the first and second upper slotters 610, 620 and the first and second lower slotters 611, 621 provided, respectively, in the first and second slotter units 61, 62. Further, the control device 100 is operable to control the differential adjustment motor in each of the differential positioning mechanisms 650A, 650B to adjust a rotational phase of a corresponding one of the first and second slotter shafts 615, 625 provided, respectively, in the first and second slotter units 61, 62. In this way, a rotational phase of each of the first and second stationary blades 612, 622 fixed, respectively, to the first and second upper slotters 610, 620 is adjusted. That is, the control device 100 is operable to control the differential adjustment motor in each of the differential positioning mechanisms 650A, 650B to perform positioning control for a corresponding one of the first and second stationary blades 612, 622.

Further, the control device 100 is operable to control the phase adjustment motor 643 in each of the displaceable blade displacement adjustment mechanisms 660A, 660B to adjust a rotational phase of a corresponding one of the adjustment shafts 641 provided, respectively, in the first and second slotter units 61, 62. In this way, with regard to the first slotter unit 61, the rotational phase of the first displaceable blade 613 with respect to the first stationary blade 612 is adjusted, and, with regard to the second slotter unit 62, the rotational phase of the second displaceable blade 623 with respect to the second stationary blade 622 is adjusted. That is, the control device 100 is operable to control the phase adjustment motor 643 in each of the displaceable blade displacement adjustment mechanisms 660A, 660B to perform positioning control for a corresponding one of the first and second displaceable blades 613, 623.

As depicted in FIG. 4, the control device 100 is configured to accept an input of a signal from a manipulation panel 110 to be manipulated by an operator, and an input of signals (detection signals) from the position sensors 671, 672 (see FIG. 2) in the slotter device 6. The control device 100 is operable, based on the signals input in this manner, to perform the positioning control as described above. The control device 100 is also operable to perform control of causing a display device 120 to display given information. An example of the information to be displayed on the display device 120 will be described later.

<Single Slotter Mode>

Next, the single slotter mode (hereinafter occasionally expressed as "SSL mode") to be implemented by the slotter device 6 for the purpose of the two-up production in this embodiment will be specifically described.

Figure 5:
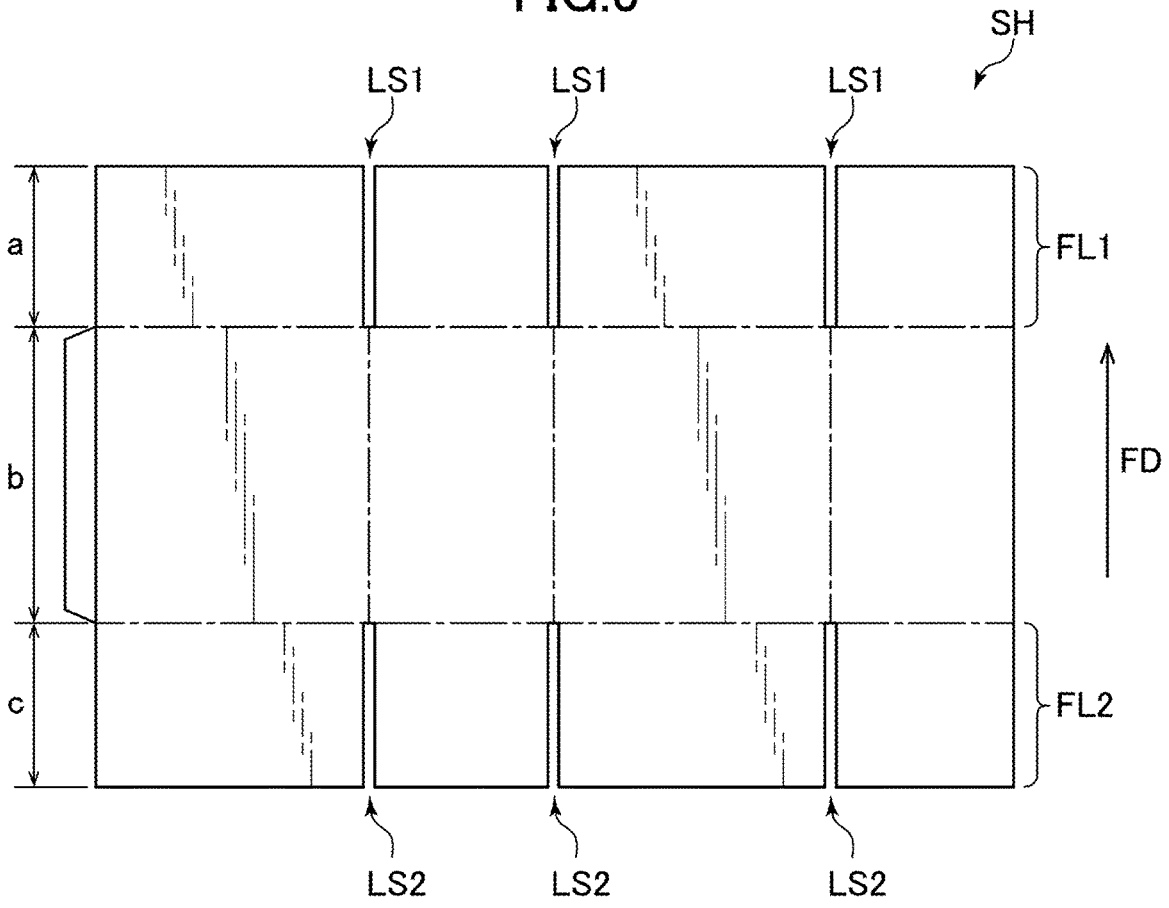
FIG. 5 is a top plan view of a corrugated paperboard sheet after being subjected to slotting.

Before explanation of the single slotter mode, fundamental matters concerning slotting by the slotter device 6 will be described with reference to FIG. 5. FIG. 5 is a top plan view of the corrugated paperboard sheet SH after being subjected to slotting. Slotting to be described here is applicable to not only the single slotter mode but also the double slotter mode.

In FIG. 5, a plurality of (three) areas designated by the reference sign LS1 are slots located in a top flap portion FL1 of the corrugated paperboard sheet SH which is subjected to slotting using the slotter device 6. Further, a plurality of (three) areas designated by the reference sign LS2 are slots located in a bottom flap portion FL2 of the corrugated paperboard sheet SH which is subjected to slotting using the slotter device 6. In the following description, a length of the top flap portion FL1 and a length of the bottom flap portion FL2 will be expressed, respectively, as "a" and "c", and a length of a portion of the corrugated paperboard sheet SH between the top flap portion FL1 and the bottom flap portion FL2, i.e., a box depth, will be expressed as "b", as depicted in FIG. 5.

Figure 6:
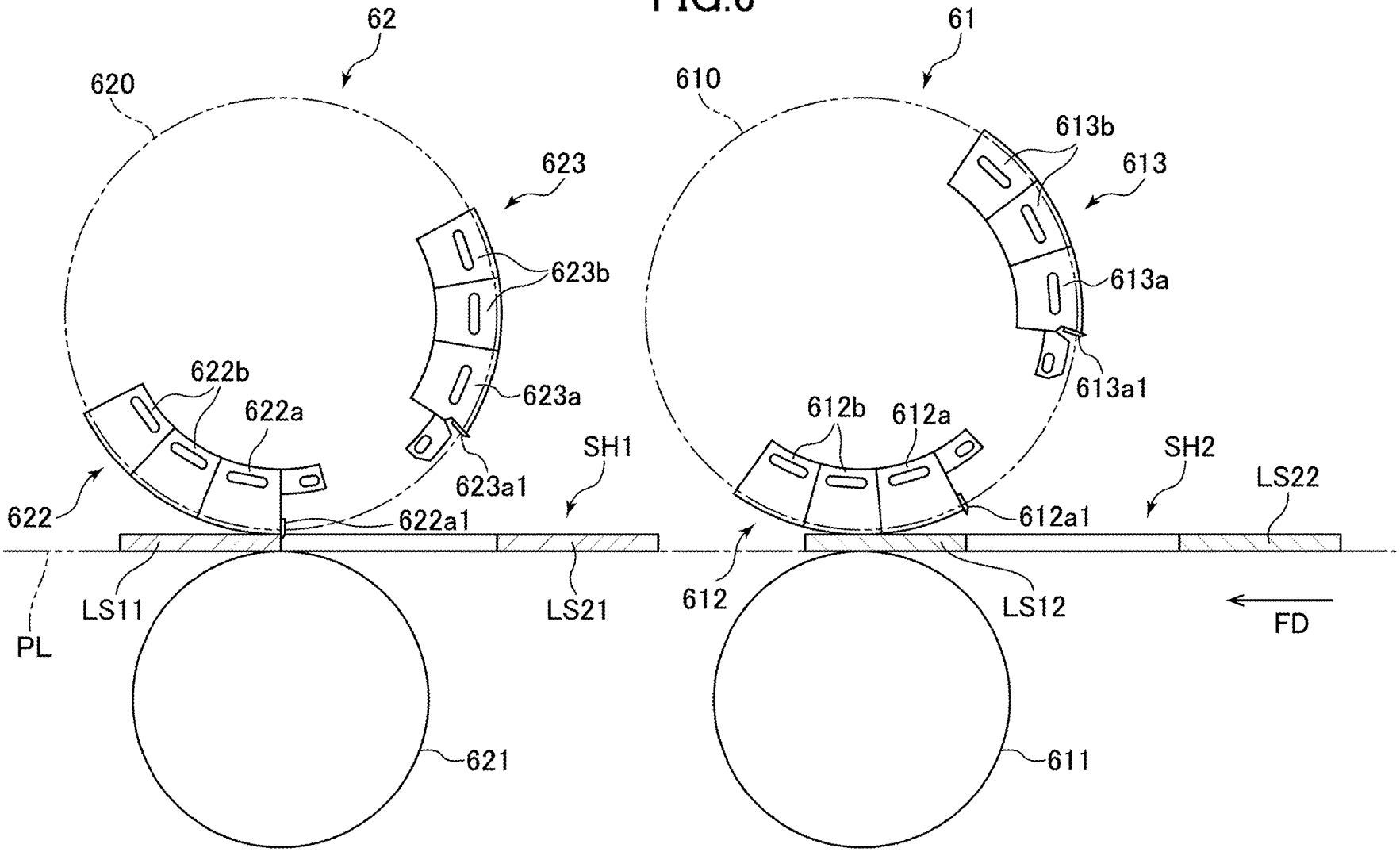
FIG. 6 is a diagram depicting a specific state of the first and second slotter units in a single slotter mode, in this embodiment.

Next, with reference to FIG. 6, the single slotter mode in this embodiment will be specifically described. FIG. 6 is a diagram depicting a specific state of the first and second slotter units 61, 62 of the slotter device 6 in the single slotter mode. Specifically, FIG. 6 is a front view enlargedly depicting major components (particularly, the stationary blades and the displaceable blades) in the first and second slotter units 61, 62.

In the example depicted in FIG. 6, with regard to the first slotter unit 61, the first stationary blade 612 comprises: a chisel-edged blade 612*a* provided with the chisel 612*a*1 at an edge thereof; and two joint blades 612*b* coupled to the chisel-edged blade 612*a*, and the first displaceable blade 613 comprises: a chisel-edged blade 613*a* provided with the chisel 613*a*1 at an edge thereof; and two joint blades 613*b* coupled to the chisel-edged blade 613*a*. In the first stationary blade 612, the chisel-edged blade 612*a* is provided on a leading side in the direction opposite to the rotational direction of the first upper slotter 610, so that the chisel 612*a*1 is located at the edge of the first stationary blade 612 on the leading side in the direction opposite to the rotational direction. Further, in the first displaceable blade 613, the chisel-edged blade 613*a* is provided on a leading side in the rotational direction of the first upper slotter 610, so that the chisel 613*a*1 is located at the edge of the first displaceable blade 613 on the leading side in the rotational direction. Similarly, with regard to the second slotter unit 62, the second stationary blade 622 comprises: a chisel-edged blade 622*a* provided with the chisel 622*a*1 at an edge thereof; and two joint blades 622*b* coupled to the chisel-edged blade 622*a*, and the second displaceable blade 623 comprises: a chisel-edged blade 623*a* provided with the chisel 623*a*1 at an edge thereof; and two joint blades 623*b* coupled to the chisel-edged blade 623*a*. In the second stationary blade 622, the chisel-edged blade 622*a* is provided on a leading side in the direction opposite to the rotational direction of the second upper slotter 620, so that the chisel 622*a*1 is located at the edge of the second stationary blade 622 on the leading side in the direction opposite to the rotational direction. Further, in the second displaceable blade 623, the chisel-edged blade 623*a* is provided on a leading side in the rotational direction of the second upper slotter 620, so that the chisel 623*a*1 is located at the edge of the second displaceable blade 623 on the leading side in the rotational direction.

In the single slotter mode, the first stationary blade 612 and the first displaceable blade 613 in the first slotter unit 61 are arranged on the outer periphery of the first upper slotter 610, while being spaced apart from each other by a given distance, and the second stationary blade 622 and the second displaceable blade 623 in the second slotter unit 62 are arranged on the outer periphery of the second upper slotter 620, while being spaced apart from each other by a given distance. In a state in which the slotter blades are arranged in this manner, two corrugated paperboard sheets SH1, SH2 are fed during a period in which each of the first and second upper slotters 610, 620 is rotated 360 degrees, and the first and second slotter unit 61, 62 are controlled to perform slotting, respectively, on the two corrugated paperboard sheets SH2, SH1. Specifically, in the single slotter mode, the first stationary blade 612 of the first slotter unit 61 operates to cut a slot in a top flap portion LS12 of the corrugated paperboard sheet SH2 on an upstream side in the conveyance direction FD, and the first displaceable blade 613 of the first slotter unit 61 operates to cut a slot in a bottom flap portion LS22 of the same corrugated paperboard sheet SH2. Further, the second stationary blade 622 of the second slotter unit 62 operates to cut a slot in a top flap portion LS11 of the corrugated paperboard sheet SH1 on a downstream side in the conveyance direction FD, and the second displaceable blade 623 of the second slotter unit 62 operates to cut a slot in a bottom flap portion LS21 of the same corrugated paperboard sheet SH1.

In this embodiment, in order to adequately realize the above slotting in the single slotter mode, the control device 100 is operable to set current register values, respectively, for the first and second stationary blades 612, 622 and the first and second displaceable blades 613, 623 so as to perform positioning control for these blades. In this case, a current register value to be applied to the stationary blade is set on the basis of a position a downstream edge (leading edge) of a corrugated paperboard sheet to be subjected to slotting, as a parameter (first and second positioning parameters) indicative of a relative position at which the chisel of the stationary blade is to be disposed with respect to the leading edge of the corrugated paperboard sheet. On the other hand, a current register value to be applied to the displaceable blade is set on the basis of a position of the chisel of the stationary blade, as a parameter (third and fourth positioning parameters) indicative of a relative position at which the chisel of the displaceable blade is to be disposed with respect to the chisel of the stationary blade (this relative position is equivalent to a circumferential length along the outer periphery of the upper slotter). These definitions of the current register values are also applied to the double slotter mode, as well as the single slotter mode.

Figures 7, 8:
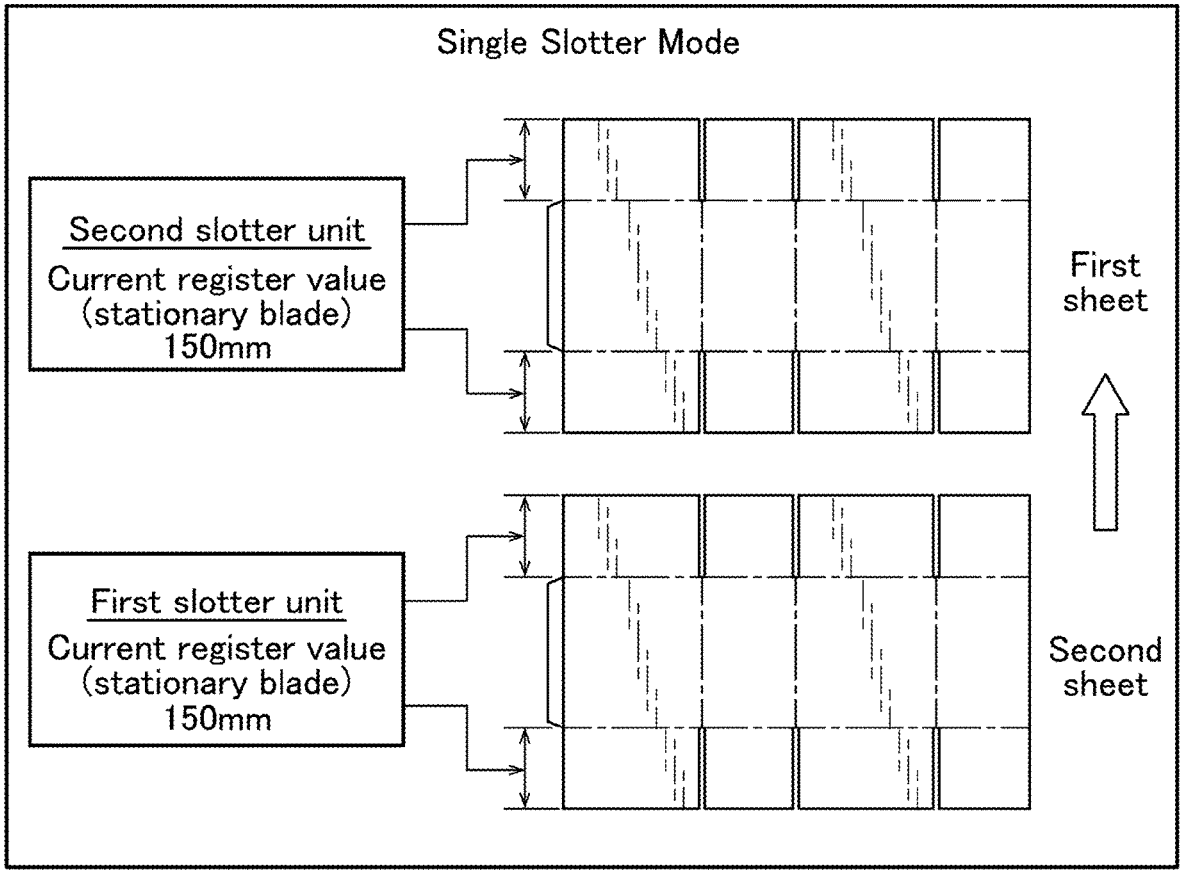
FIG. 7 is a table presenting current register values to be applied to slotter blades in the single slotter mode, in this embodiment.
FIG. 8 depicts an example of a display screen image in the single slotter mode, in this embodiment.

Next, with reference to FIG. 7 in addition to FIG. 6, the current register values to be applied to the single slotter mode in this embodiment will be specifically described. FIG. 7 is a table presenting the current register values to be applied to the slotter blades in the single slotter mode, in this embodiment.

As described above, in the single slotter mode, each of the first and second stationary blades 612, 622 in the first and second slotter units 61, 62 operates to cut a slot in a respective one of the top flap portions LS12, LS11 of the corrugated paperboard sheets SH2, SH1, and each of the first and second displaceable blades 613, 623 in the first and second slotter units 61, 62 operates to cut a slot in a respective one of the bottom flap portions LS22, LS21 of the corrugated paperboard sheets SH2, SH1 (see FIG. 6). In this case, each of the chisels 612*a*1, 622*a*1 of the first and second stationary blades 612, 622 is set to be coincident with a respective one of upstream edges of the top flap portions LS12, LS11 (i.e., trailing edges of areas to be subjected to slotting in the top flap portions LS12, LS11), and each of the chisels 613*a*1, 623*a*1 of the first and second displaceable blades 613, 623 is set to be coincident with a respective one of downstream edges of the bottom flap portions LS22, LS21 (i.e., leading edges of areas to be subjected to slotting in the bottom flap portions LS22, LS21). That is, in a situation where each of the first and second upper slotters 610, 620 is rotated, and each of the corrugated paperboard sheets SH1, SH2 is moved along the conveyance direction FD, each of the chisels 612*a*1, 622*a*1 of the first and second stationary blades 612, 622 being rotated is set to be brought into contact with a respective one of the trailing edges of the top flap portions LS12, LS11, when each of the chisels 612*a*1, 622*a*1 reaches a respective one of the corrugated paperboard sheets SH2, SH1 being conveyed, and each of the chisels 613*a*1, 623*a*1 of the first and second displaceable blades 613, 623 being rotated is set to be brought into contact with a respective one of the leading edges of the bottom flap portions LS22, LS21, when each of the chisels 613*a*1, 623*a*1 reaches a respective one of the corrugated paperboard sheets SH2, SH1 being conveyed.

In order to realize such relative positional relationships of the slotter blades and the corrugated paperboard sheets, current register values presented in FIG. 7 are employed. Specifically, when performing the single slotter mode, the control device 100 is operable to set each of the current register values of the first and second stationary blades 612, 622 to "a" which is a length dimension (in the conveyance direction FD) of each of the top flap portions LS11, LS12 of the corrugated paperboard sheets SH1, SH2. Further, the control device 100 is operable to set each of the current register values of the first and second displaceable blades 613, 623 to "b" which is a box depth dimension of each of the corrugated paperboard sheets SH1, SH2.

Then, the control device 100 is operable to perform positioning control for the slotter blades, based on the current register values set as present in FIG. 7. Specifically, the control device 100 is operable to set a numerical value of the length dimension "a" of each of the top flap portions LS11, LS12 of the corrugated paperboard sheets SH1, SH2, as each of the current register values of the first and second stationary blades 612, 622, and control the differential adjustment motors of the differential positioning mechanisms 650A, 650B to thereby perform positioning control for the first and second stationary blades 612, 622. Further, the control device 100 is operable to set a numerical value of the box depth dimension "b" of the corrugated paperboard sheets SH1, SH2, as the current register values, and control the phase adjustment motors 643 of the displaceable blade displacement adjustment mechanisms 660A, 660B, to thereby perform positioning control for the first and second displaceable blades 613, 623.

Next, with reference to FIG. 8, a display screen image in the single slotter mode, in this embodiment, will be described. FIG. 8 depicts an example of a screen image displayed on the display device 120 by the control device 100 in the single slotter mode. As depicted in FIG. 8, this display screen image is configured to enable an operator to easily understand two corrugated paperboard sheets to be subjected to slotting using the first and second slotter units 61, 62, respectively, and a zone of each of the corrugated paperboard sheets to be subjected to slotting. This display screen image also indicates respective current register values of the first and second stationary blades 612, 622 of the first and second slotter units 61, 62. FIG. 8 depicts one example where the length dimension "a" of the top flap portion in each of the corrugated paperboard sheets is 150 mm, and this value "150 mm" is indicated as each of the current register values of the first and second stationary blades 612, 622. An operator checks the current register value displayed in this manner to figure out a relationship of the displayed value and a processing size (i.e., box size) of each of the corrugated paperboard sheets SH1, SH2, and performs various adjustments concerning the slotter device 6.

<Double Slotter Mode>

Next, the double slotter mode (hereinafter occasionally expressed as "WSL mode") to be implemented by the slotter device 6 for the purpose of the normal production in this embodiment will be specifically described.

Figure 9:
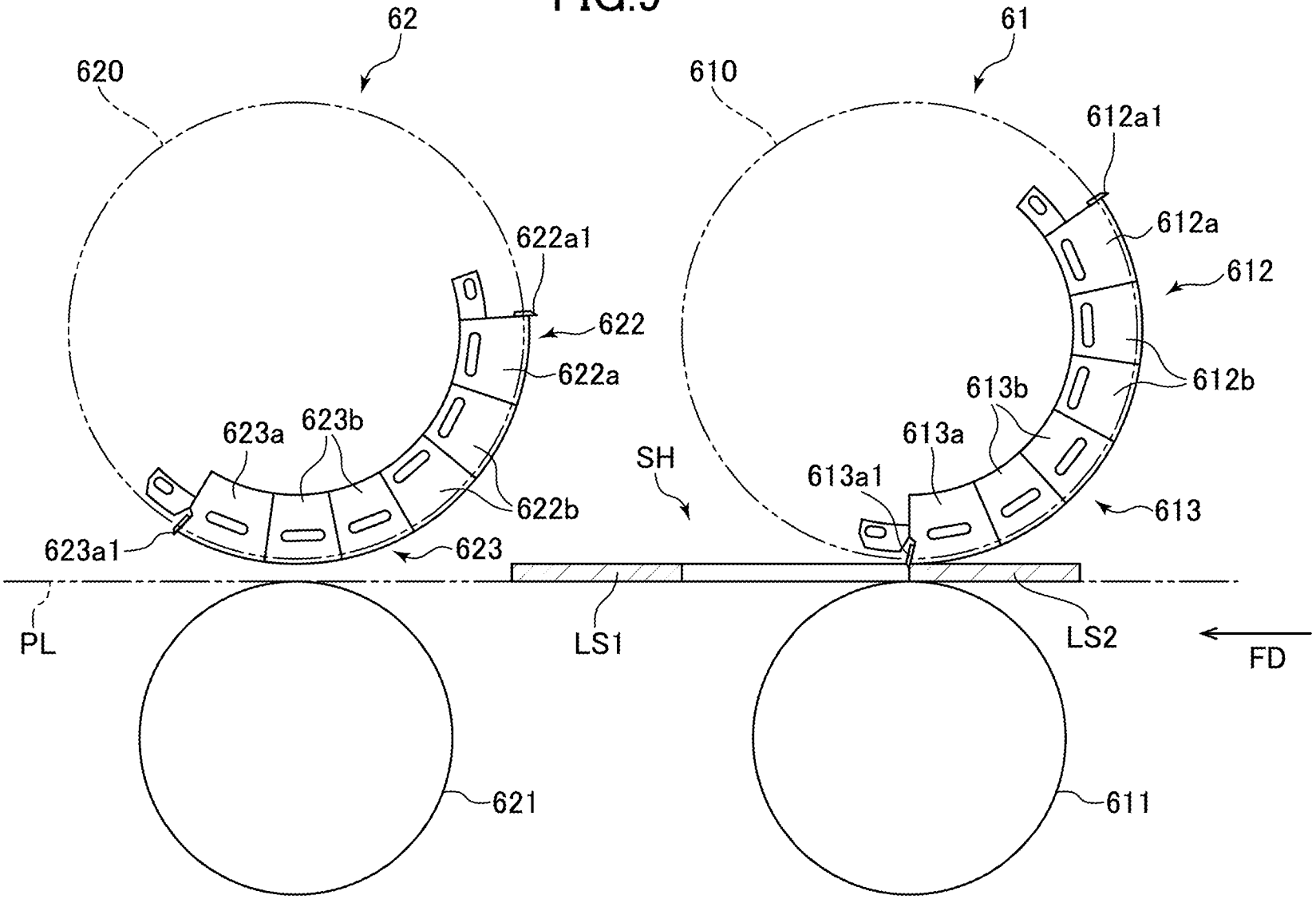
FIG. 9 is a diagram depicting a specific state of the first and second slotter units in a double slotter mode, in this embodiment.

FIG. 9 is a diagram depicting a specific state of the first and second slotter units 61, 62 of the slotter device 6 in a double slotter mode. Specifically, FIG. 9 is a front view enlargedly depicting major components (particularly, the stationary blades and the displaceable blades) in the first and second slotter units 61, 62. Respective configurations of the slotters used in FIG. 9 are the same as those in FIG. 6, and therefore description of them will be omitted.

In the double slotter mode, the first stationary blade 612 and the first displaceable blade 613 in the first slotter unit 61 are arranged on the outer periphery of the first upper slotter 610, while being in contact with each other, and the second stationary blade 622 and the second displaceable blade 623 in the second slotter unit 62 are arranged on the outer periphery of the second upper slotter 620, while being in contact with each other. That is, in the double slotter mode, one slotter blade assembly formed by integrating the first stationary blade 612 and the first displaceable blade 613 together is used, and one slotter blade assembly formed by integrating the second stationary blade 622 and the second displaceable blade 623 together is used. Specifically, one edge of the first stationary blade 612 devoid of the chisel 612*a*1 and one edge of the first displaceable blade 613 devoid of the chisel 613*a*1 are brought into contact with each other (i.e., the first stationary blade 612 and the first displaceable blade 613 are brought into contact with each other, such that the chisels 612*a*1, 613*a*1 are located, respectively, at opposite edges of the integrated slotter blade assembly), and one edge of the second stationary blade 622 devoid of the chisel 622*a*1 and one edge of the second displaceable blade 623 devoid of the chisel 623*a*1 are brought into contact with each other (i.e., the second stationary blade 622 and the second displaceable blade 623 are brought into contact with each other, such that the chisels 622*a*1, 623*a*1 are located, respectively, at opposite edges of the integrated slotter blade assembly).

In a state in which the slotter blades are arranged in this manner, one corrugated paperboard sheet SH is fed during the period in which each of the first and second upper slotters 610, 620 is rotated 360 degrees, and both of the first and second slotter unit 61, 62 are controlled to perform slotting on the corrugated paperboard sheet SH. Specifically, in the double slotter mode, at least the first displaceable blade 613 (i.e., only the first displaceable blade 613 or both of the first displaceable blade 613 and the first stationary blade 612) of the first slotter unit 61 operates to cut a slot in a bottom flap portion LS2 of the corrugated paperboard sheet SH, and at least the second stationary blade 622 (i.e., only the second stationary blade 622 or both of the second stationary blade 622 and the second displaceable blade 623) of the second slotter unit 62 operates to cut a slot in a top flap portion LS1 of the corrugated paperboard sheet SH. In this embodiment, in order to adequately realize the above slotting in the double slotter mode, the control device 100 is operable to set current register values, respectively, for the first and second stationary blades 612, 622 and the first and second displaceable blades 613, 623 so as to perform positioning control for these blades.

Figures 10, 11:
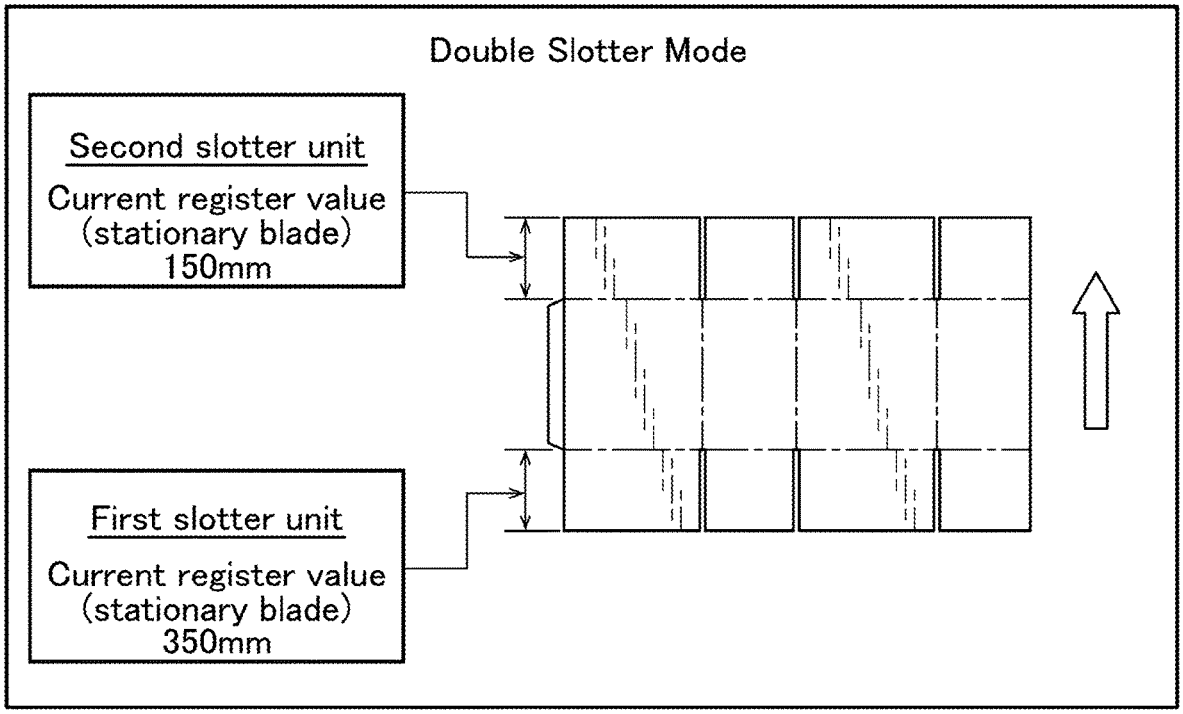
FIG. 10 is a table presenting current register values to be applied to slotter blades in the double slotter mode, in this embodiment.
FIG. 11 depicts an example of a display screen image in the double slotter mode, in this embodiment.

Next, with reference to FIG. 10 in addition to FIG. 9, the current register values to be applied to the double slotter mode in this embodiment will be specifically described. FIG. 10 is a table presenting the current register values to be applied to the slotter blades in the double slotter mode, in this embodiment.

As described above, during the double slotter mode, at least the first displaceable blade 613 in the first slotter unit 61 operates to cut a slot in the bottom flap portion LS2 of the corrugated paperboard sheet SH, and at least the second stationary blade 622 in the second slotter unit 62 operates to cut a slot in the top flap portion LS1 of the corrugated paperboard sheet SH (see FIG. 9). In this case, the chisel 613*a*1 of the first displaceable blade 613 is set to be coincident with a downstream edge of the bottom flap portion LS2 (i.e., a leading edge of an area to be subjected to slotting in the bottom flap portion LS2), and the chisel 622*a*1 of the second stationary blade 622 is set to be coincident with an upstream edges of the top flap portion LS1 (i.e., trailing edge of an area to be subjected to slotting in the top flap portion LS1). That is, in a situation where the first upper slotter 610 is rotated, and the corrugated paperboard sheet SH is moved along the conveyance direction FD, the chisel 613*a*1 of the first displaceable blade 613 being rotated is set to be brought into contact with the leading edge of the bottom flap portion LS2, when the chisel 613*a*1 reaches the corrugated paperboard sheet SH being conveyed. Further, in a situation where the second upper slotter 620 is rotated, and the corrugated paperboard sheet SH is moved along the conveyance direction FD, the chisel 622*a*1 of the second stationary blade 622 being rotated is set to be brought into contact with the trailing edge of the top flap portion LS1, when the chisel 622*a*1 reaches the corrugated paperboard sheet SH being conveyed.

In order to realize such relative positional relationships of the slotter blades and the corrugated paperboard sheet, current register values presented in FIG. 10 are employed. In this case, the following codes are used in addition to the aforementioned "a", "b" and "c".

D: a diameter of the first and second upper slotters 610, 620 (basically, corresponding to a reference diameter of the printing cylinder 40)

f: a blade length of the first stationary blade 612 (specifically, an arc length of the first stationary blade 612)

g: a blade length of the first displaceable blade 613 (specifically, an arc length of the first displaceable blade 613)

d: a blade length of the second stationary blade 622 (specifically, an arc length of the second stationary blade 622)

e: a blade length of the second displaceable blade 623 (specifically, an arc length of the second displaceable blade 623)

When performing the double slotter mode, first of all, the control device 100 is operable to set the current register value of the second stationary blade 622 of the second slotter unit 62 to "a" which is a length dimension of the top flap portion LS1 of the corrugated paperboard sheet SH, as is the case in the single slotter mode (see FIG. 10). This is because, in the double slotter mode, the second stationary blade 622 of the second slotter unit 62 operates to cut a slot in the top flap portion LS1 of the corrugated paperboard sheet SH, in the same manner as that in the single slotter mode.

As described above, in the double slotter mode, the first stationary blade 612 and the first displaceable blade 613 are brought into contact with each other, and the second stationary blade 622 and the second displaceable blade 623 are brought into contact with each other. On the other hand, current register values of the first and second displaceable blades 613, 623 is set, respectively, to a circumferential length from the chisel 612*a*1 of the first stationary blade 612 to the chisel 613*a*1 of the first displaceable blade 613, a circumferential length from the chisel 622*a*1 of the second stationary blade 622 to the chisel 623*a*1 of the second displaceable blade 623 (specifically, as measured along a direction opposite to the rotational direction of each of the first and second upper slotters 610, 620). Therefore, in the contact state between the slotter blades in the double slotter mode, the current register value of the first displaceable blade 613 is set using a total blade length (f+g) of respective circumferential lengths of the first stationary blade 612 and the first displaceable blade 613, and the current register value of the second displaceable blade 623 is set using a total blade length (d+e) of respective circumferential lengths of the second stationary blade 622 and the second displaceable blade 623. Specifically, the current register values of the first and second displaceable blades 613, 623 are set, respectively, to a value obtained by subtracting the total blade length "f+g" from the circumference "D×π" of each of the first and second upper slotters 610, 620, and a value obtained by subtracting the total blade length "d+e" from the circumference "D×π" of each of the first and second upper slotters 610, 620. Therefore, when implementing the double slotter mode, the control device 100 is operable to set the current register value of the first displaceable blade 613 of the first slotter unit 61 to "D×π−(f+g)", and set the current register value of the second displaceable blade 623 of the second slotter unit 62 to "D×π−(d+e)" (see FIG. 10).

As above, the total blade lengths "f+g", "d+e" are requited when setting the current register values of the first and second displaceable blades 613, 623. A technique of acquiring the total blade lengths will be described later.

Then, the current register value of the first stationary blade 612 is set in the following manner. Differently from the single slotter mode, in the double slotter mode, one corrugated paperboard sheet SH is subjected to slotting using both of the first and second slotter units 61, 62. Therefore, in the double slotter mode, the downstream edge (leading edge) of the corrugated paperboard sheet SH used as a reference position for the current register value of the second stationary blade 622 is also use as a reference position for the current register value of the first stationary blade 612. Further, in the normal production employing the double slotter mode, successive preceding and following corrugated paperboard sheets SH are fed while being spaced apart from each other by the circumference of the upper slotter. Thus, in order to set the current register value of the first stationary blade 612 to a value with respect to the reference position for the second stationary blade 622 (i.e., the leading edge of the corrugated paperboard sheet SH which reaches the second slotter unit), processing of subtraction by a length "D×π/2" obtained by dividing the circumference of the first upper slotter 610 (or the second upper slotter 620) in half is used for the current register value of the first stationary blade 612. Further, in the double slotter mode, the leading edge of the bottom flap portion LS2 of the corrugated paperboard sheet SH is cut by the chisel 613*a*1 of the first displaceable blade 613 in the first slotter unit 61, so that the first stationary blade 612 is brought into contact with an edge of the first displaceable blade 613 on a leading side in the direction opposite to the rotational direction of the first upper slotter 610 (see FIG. 9). In this case, in a slotter blade assembly formed by bringing the first stationary blade 612 and the first displaceable blade 613 into contact with each other and integrating them together, the chisel 612*a*1 of the first stationary blade 612 is located at one edge of the slotter blade assembly on a side opposite to the chisel 613*a*1 of the first displaceable blade 613. Thus, the chisel 612*a*1 of the first stationary blade 612 is located away from the chisel 613*a*1 of the first displaceable blade 613 by the total blade length "f+g".

Considering the above, the current register value of the first stationary blade 612 is set to a value obtained by: adding the length dimension "a" of the top flap portion LS1 of the corrugated paperboard sheet SH, the box depth "b", and the total blade length "f+g" of the first stationary blade 612 and the first displaceable blade 613; and subtracting the length "D×π/2" derived from dividing the circumference of the first upper slotter 610 in half, from the added value. Thus, when performing the double slotter mode, the control device 100 is operable to set the current register value of the first stationary blade 612 of the first slotter unit 61 to "a+b−{(D×π/2)−(f+g)}" (see FIG. 10).

Then, based on the current register values set in the above manner, the control device 100 is operable to perform positioning control for the slotter blades. Specifically, in the double slotter mode, first of all, the control device 100 is operable to control the phase adjustment motors 643 of the displaceable blade displacement adjustment mechanisms 660A, 660B to displace the first and second displaceable blades 613, 623 so as to bring them into contact, respectively, with the first and second stationary blades 612, 622. Then, the control device 100 is operable to set the current register valves of the first and second stationary blades 612, 622, from various parameter values (see FIG. 10), and control the differential adjustment motors of the differential positioning mechanisms 650A, 650B to perform positioning control for each of a set of the first stationary blade 612 and the first displaceable blade 613 being in a contact state, and a set of the second stationary blade 622 and the second displaceable blade 623 being in a contact state.

Meanwhile, in the double slotter mode, the current register value of the second stationary blade 622 of the second slotter unit 62 is set to "a" which is the length dimension of the top flap portion LS1 of the corrugated paperboard sheet SH, whereas the current register value of the first stationary blade 612 of the first slotter unit 62 is set to "a+b−{(D×π/2)−(f+g)}". However, as seen from the formula "a+b−{(D×π/2)−(f+g)}", the term "{(D×π/2)−(f+g)}" is included in this formula, so that the current register value of the first stationary blade 612 diverges from the processing size of the corrugated paperboard sheet SH. As one example, assume that: each of the respective dimensions "a", "c" of the top flap portion and the bottom flap portion is 150 mm; the box depth "b" is 200 mm; the diameter D of each of the first and second upper slotters 610, 620 is 406.4 mm; each of the respective blade lengths "f", "d", "g", "e" of the first and second stationary blades 612, 622 and the first and second displaceable blades 613, 623 is 224 mm. This case shows that the current register value of the second stationary blade 613 is set to "150 mm", so that it is coincident with the processing size of the corrugated paperboard sheet SH, whereas the current register value of the first stationary blade 612 is set to "159.6 mm" from the above formula, so that it diverges from the processing size of the corrugated paperboard sheet SH.

As with the single slotter mode (see FIG. 8), in the double slotter mode, the display device 120 is also controlled to display the current register values of the first and second stationary blades 612, 622. However, if the current register value of the first stationary blade 612 diverging from the processing size of the corrugated paperboard sheet SH is displayed directly, an operator has difficulty in understanding the relationship between the displayed value and the processing size of the corrugated paperboard sheet SH.

Therefore, in this embodiment, the control device 100 is operable to cause the display device 120 to display a value obtained by correcting an actual value "a+b−{(D×π/2)−(f+g)}" of the current register value of the first stationary blade 612 to a value corresponding to the processing size of the corrugated paperboard sheet SH. Specifically, the control device 100 is operable to derive a correction constant using the formula "(D×π/2)−(f+g)", and cause the display device 120 to display a value obtained by adding the correction constant to a value derived from the formula "a+b−{(D×π/2)−(f+g)}". As a result, the control device 100 is operable to cause the display device 120 to display a value of "a+b" as the current register value of the first stationary blade 612. The value "a+b" is a value obtained by adding the length dimension "a" of the top flap portion and the box depth "b" of the corrugated paperboard sheet SH. Thus, when this value is displayed on the display device 120 as the current register value of the first stationary blade 612, an operator can easily understand the relationship between the displayed value and the processing size of the corrugated paperboard sheet SH.

Next, with reference to FIG. 11, a display screen image in the double slotter mode, in this embodiment, will be described. FIG. 11 depicts an example of a screen image displayed on the display device 120 by the control device 100 in the double slotter mode. As depicted in FIG. 11, this display screen image is configured to enable an operator to easily understand two zones of one corrugated paperboard sheet SH to be subjected to slotting using the first and second slotter units 61, 62, respectively.

Further, the display screen image depicted in FIG. 11 indicates respective current register values of the first and second stationary blades 612, 622 of the first and second slotter units 61, 62. As with the aforementioned example, this example is also based on an assumption that: each of the respective dimensions "a", "c" of the top flap portion and the bottom flap portion is 150 mm; the box depth "b" is 200 mm; the diameter D of each of the first and second upper slotters 610, 620 is 406.4 mm; each of the respective blade lengths "f", "d", "g", "e" of the first and second stationary blades 612, 622 and the first and second displaceable blades 613, 623 is 224 mm. In this case, the value "150 mm" corresponding to the length dimension "a" of the top flap portion is displayed as the current register value of the second stationary blade 622, and the value "350 mm" corresponding to a value obtained by adding the length dimension "a" of the top flap portion and the box depth "b" is displayed as the current register value of the first stationary blade 612. That is, although an actual value of the current register value of the first stationary blade 612 is set to "159.6 mm" from the above formula, "350 mm" is displayed which is a value obtained by correcting the actual current register value to a value corresponding to the processing size of the corrugated paperboard sheet SH, i.e., a value obtained by correcting the actual current register value using the correction constant. An operator checks the current register value displayed in this manner to figure out a relationship of the displayed value and the processing size of the corrugated paperboard sheet SH, and performs various adjustments concerning the slotter device 6.

<Mode Switching Control>

Next, control to be performed when switching the production mode between the single slotter mode and the double slotter mode in this embodiment will be described.

(Control for Switching from Single Slotter Mode to Double Slotter Mode)

First of all, control for switching from the single slotter mode to the double slotter mode, in this embodiment, will be described. Before explaining details of this switching control, a method of deriving a total blade length of the set of the stationary blade and the displaceable blade necessary for the switching control will be described with reference to FIG. 12.

Figure 12:
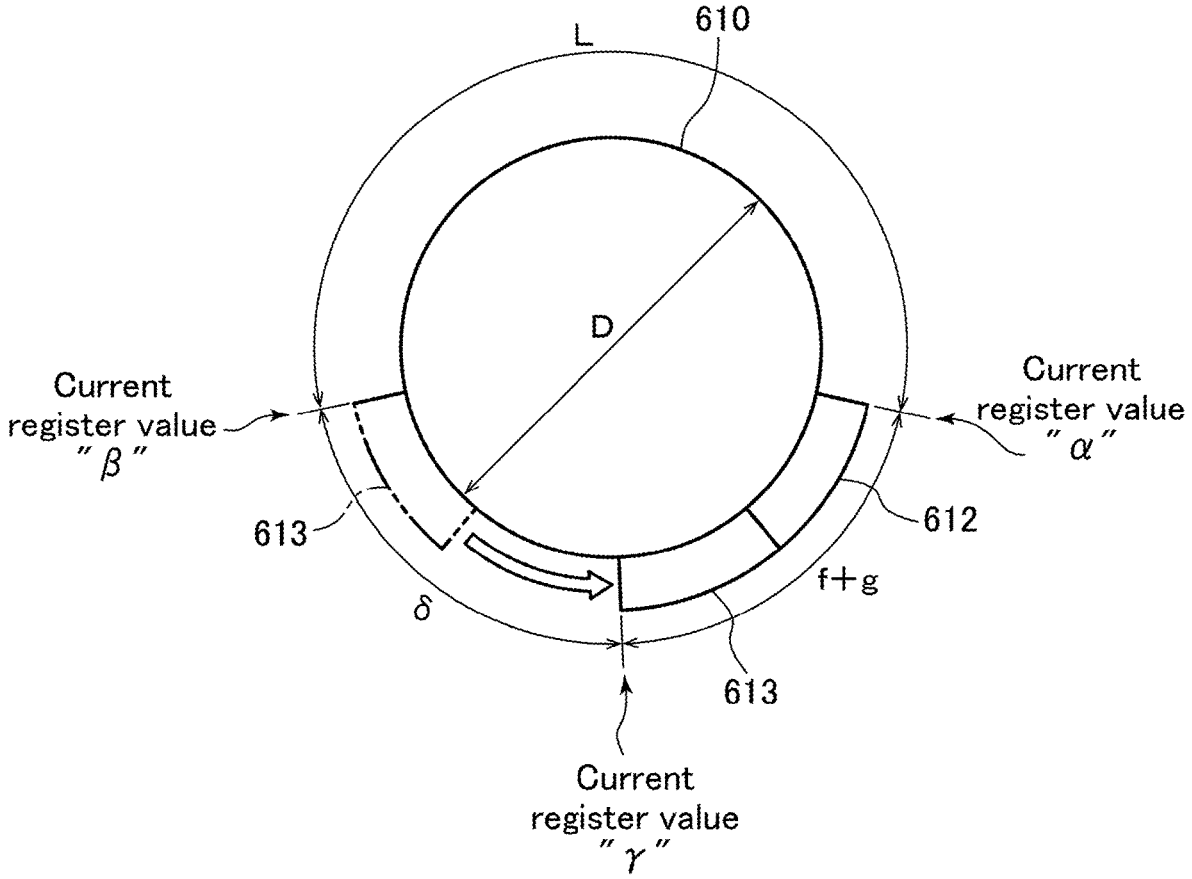
FIG. 12 is an explanatory diagram of a method of deriving a total blade length, in this embodiment.

FIG. 12 is an explanatory diagram of the method of deriving the total blade length, in this embodiment. More specifically, FIG. 12 is a schematic front view enlargedly depicting only the first upper slotter 612 of the first slotter unit 61 in this embodiment. In FIG. 12, the method of deriving the total blade length will be described, representatively using the first slotter unit 61 in the first and second slotter units 61, 62. Thus, this method is also applied to the second slotter unit 62.

In this embodiment, when switching from the single slotter mode to the double slotter mode, the control device 100 is operable to perform control for automatically deriving the total blade length of the set of the stationary blade and the displaceable blade. This is because the total blade length is required when positioning the set of the stationary blade and the displaceable blade so as to perform the double slotter mode. Basically, before performing the double slotter mode, the control device 100 has not figured out the total blade length. Thus, the control device 100 is configured to derive the total blade length when performing the double slotter mode.

Particularly, in this embodiment, the control device 100 is operable to enable the displaceable blade located at a position spaced apart from the stationary blade to be gradually displaced and thereby brought into contact with the stationary blade, and derive the total blade length of the stationary blade and the displaceable blade in this contact state. Specifically, first of all, the control device 100 is operable to enable the first stationary blade 612 and the first displaceable blade 613 to be positioned, respectively, at first and second reference positions, as depicted in FIG. 12. Specifically, on an assumption that, in a state in which the position of the first stationary blade 612 is fixed, the first displaceable blade 613 is displaced and brought into contact with the first stationary blade 612, the control device 100 is operable to position the first stationary blade 612 at a first reference position (indicated by the current register value $\alpha$) which is a position suitable for allowing the first displaceable blade 613 being displaced to be brought into contact therewith. Further, the control device 100 is operable to position the first displaceable blade 613 at a second reference position (indicated by the current register value $\beta$) which is a position to be disposed before start of displacement for contact with the first stationary blade 612.

The first and second reference positions are set in a lower region of the circumference of a cylinder of the first upper slotter 610 (typically, a region corresponding to a lower half of the first upper slotter 610). This makes it possible to prevent occurrence of defective contact between the first stationary blade 612 and the first displaceable blade 613 or damage to the displaceable blade displacement adjustment mechanism 660A, which would otherwise be caused by foreign particles, such as paper fragment or paper powder, pinched between the first stationary blade 612 and the first displaceable blade 613 during the course of deriving the total blade length. Further, the first and second reference positions are set at positions where the first stationary blade 612 and the first displaceable blade 613 are free from interference therebetween even in the case where one or each of these blades has a relatively long blade length.

Then, the control device 100 is operable to control the phase adjustment motor 643 as a servo motor, in the displaceable blade displacement adjustment mechanism 660A to displace the first displaceable blade 613 slowly, i.e., inch the first displaceable blade 613, toward the first stationary blade 612, from a state in which the first stationary blade 612 is positioned at the first reference position, and the first displaceable blade 613 is positioned at the second reference position. During the above displacement of the first displaceable blade 613, the control device 100 is operable to acquire a drive current of the phase adjustment motor 643, and, based on a torque corresponding to the acquired drive current (which is equivalent to a torque given from the phase adjustment motor 643 to the first displaceable blade 613), to determine whether or not the first displaceable blade 613 has been brought into contact with the first stationary blade 612. Specifically, the control device 100 is operable, when the torque corresponding to the acquired drive current of the phase adjustment motor 643 has exceeded a given threshold, to determine that the first displaceable blade 613 has been brought into contact with the first stationary blade 612. By using such a torque, it becomes possible to accurately determine the fact that the first displaceable blade 613 has been brought into contact with the first stationary blade 612. Then, when determining that the first displaceable blade 613 has been brought into contact with the first stationary blade 612, the control device 100 is operable to disable the displacement of the first displaceable blade 613, and store a current register value $\gamma$ of the first displaceable blade 613 at this stopped position.

In this state, the total blade length "f+g" of the first stationary blade 612 and the first displaceable blade 613 is set to a length obtained by subtracting a distance L between the first stationary blade 612 located at the first reference position and the first displaceable blade 613 located at the second reference position and a distance 6 by which the first displaceable blade 613 is displaced from the second reference position to a position where it is brought into contact with the first stationary blade 612, from the circumference "$\pi D$" of the first upper slotter 610, as depicted in FIG. 12. That is, the total blade length is expressed as the following formula: "$f+g=\pi D-L-\delta$". In this formula, using the current register values $\alpha$, $\beta$, $\delta$, L and $\delta$ are expressed, respectively, as "$L=\beta-\alpha$" and "$\delta=\gamma-\beta$". Thus, when these converted values are assigned to the formula, the total blade length is expressed as follows: "$f+g=\pi D-\alpha-\gamma$"

Thus, the control device 100 is operable to assign a value of the current register value $\alpha$ of the first stationary blade 612 and a value of the current register value $\gamma$ of the first displaceable blade 613 to the formula "$f+g=\pi D-\alpha-\gamma$" to thereby derive the total blade length "f+g" of the first stationary blade 612 and the first displaceable blade 613. Then, the control device 100 is operable to store the derived total blade length "f+g".

In the above description, the total blade length is expressed as "f+g". However, the total blade length derived by the method in this embodiment is an actual arc length in one slotter blade assembly formed by bringing the first stationary slotter blade 812 and the first displaceable slotter blade 813 into contact with each other and integrating them together, wherein the actual arc length is not exactly equal to a length obtained by simply adding the blade length f of the first stationary blade 612 itself and the blade length g of the first displaceable blade 613 itself, in some cases. Thus, in this embodiment, even in a situation where, in the contact state, there is a slight gap between the first stationary blade 612 and the first displaceable blade 613, it is possible to accurately obtain the total blade length while taking into account such a gap. This makes it possible to accurately perform the positioning control and others in the double slotter mode.

With regard to the second slotter unit 62, the control device 100 is operable to derive the total blade length "d+e" of the second stationary blade 622 and the second displaceable blade 623 by the same method as that described above, and store a obtained value of the total blade length "d+e". It should be noted that, in the second slotter unit 62, a reference position set for the second stationary blade 622 and a reference position set for the second displaceable blade 623 will hereinafter be referred to respectively as "third reference position" and "fourth reference position". Basically, the third reference position and the fourth reference position are identical, respectively, to the first reference position and the second reference position. Thus, the following description will be made by generically using the term "first reference position" without discriminating the first reference position and the third reference position, and further generically using the term "second reference position" without discriminating the second reference position and the fourth reference position.

Figure 13:
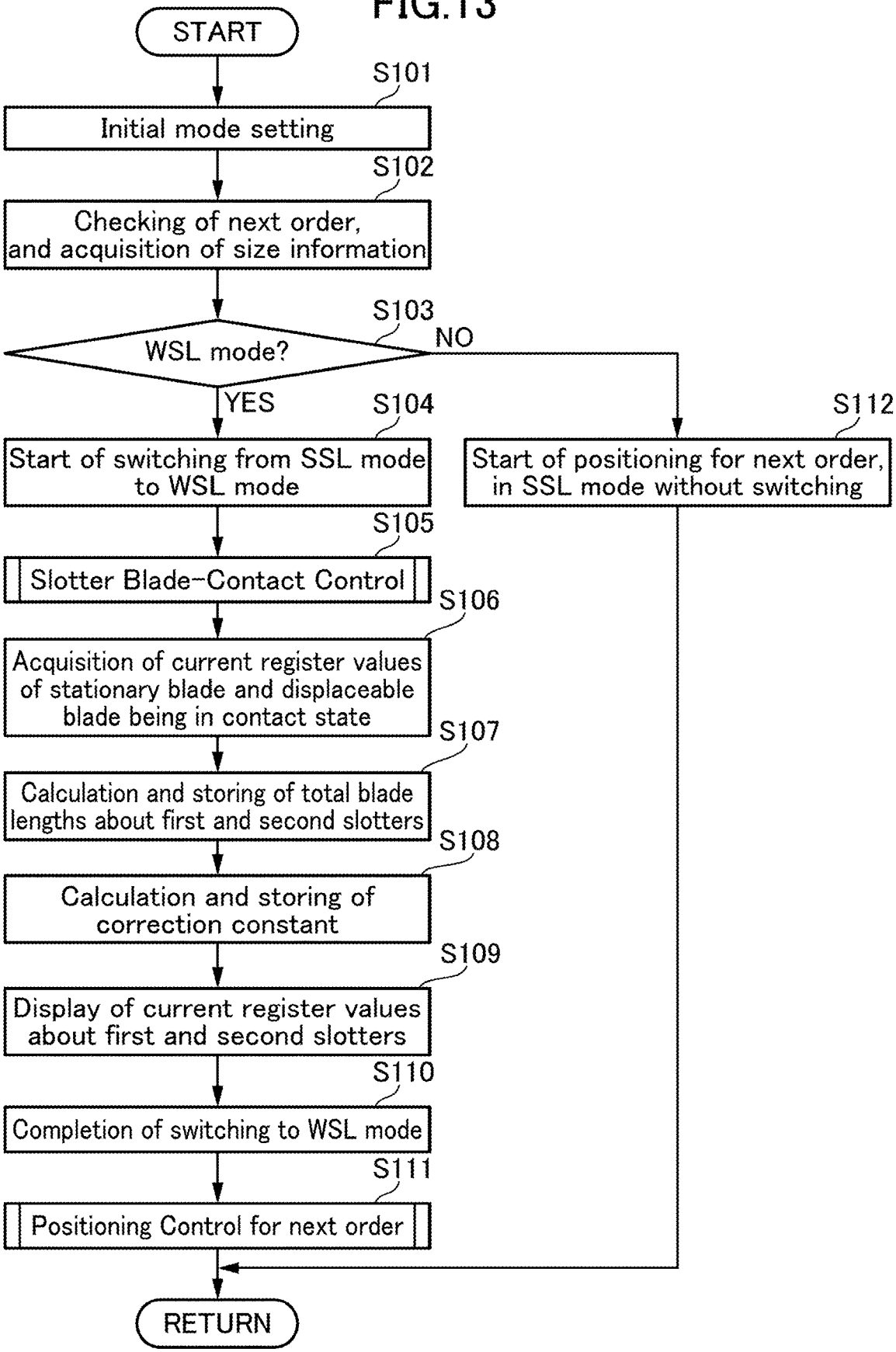
FIG. 13 is a flowchart presenting control for switching from the single slotter mode to the double slotter mode, in this embodiment.
Figure 14:
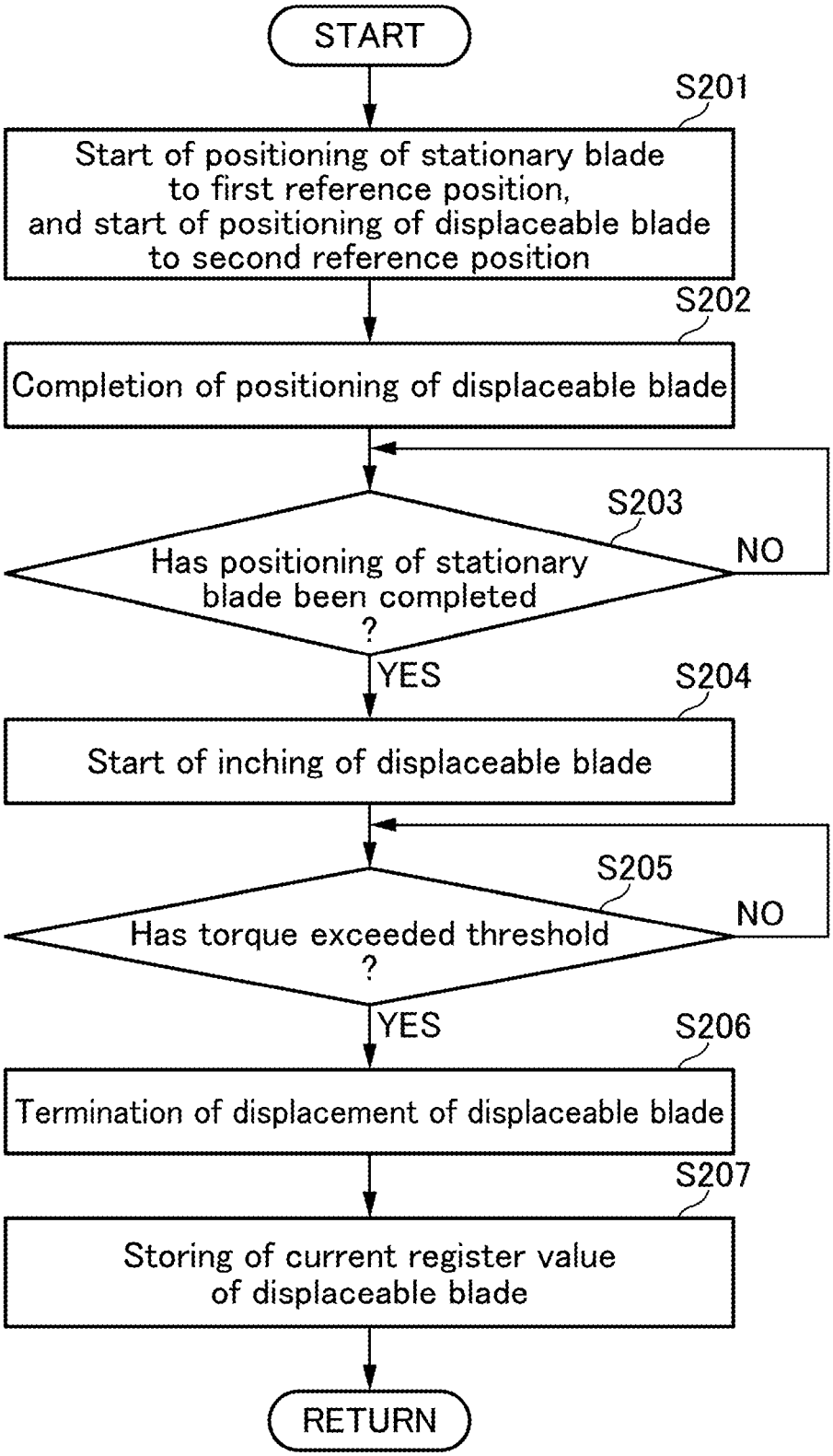
FIG. 14 is a flowchart presenting a slotter blade-contact control, in this embodiment.
Figure 15:
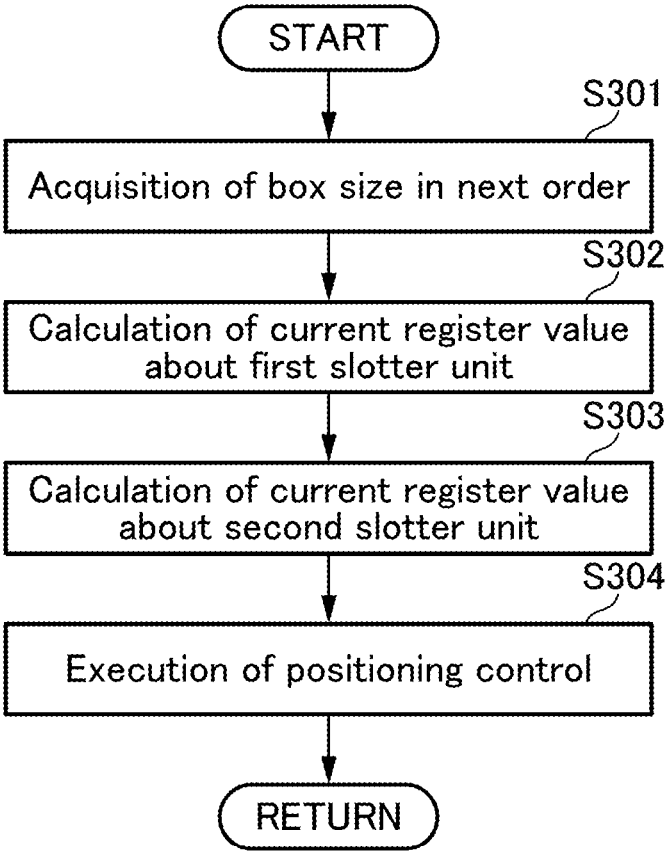
FIG. 15 is a flowchart presenting a positioning control for a next order, in this embodiment.

Next, with reference to FIGS. 13 to 15, the control for switching the single slotter mode to the double slotter mode in this embodiment will be specifically described. FIG. 13 is a flowchart presenting the control for switching from the single slotter mode to the double slotter mode, in this embodiment. FIG. 14 is a flowchart presenting a slotter blade-contact control for bringing the displaceable blade and the stationary blade into contact with each other, to be performed during the switching control. FIG. 15 is a flowchart presenting a positioning control for a next order, to be performed during the switching control. The following description will be made on an assumption that, at start of the flow in FIG. 13, the production mode of the slotter device 6 is set to the single slotter mode.

As depicted in FIG. 13, first of all, in step S101, the control device 100 starts initial mode setting about the slotter device 6. Then, in step S102, the control device 100 checks production mode to be set in a next order, and acquires size information (processing size) about a corrugated paperboard sheet to be subjected to slotting in the next order. For example, the control device 100 acquires production mode and size information input by an operator via the manipulation panel 110.

Subsequently, in step S103, the control device 100 determines whether or not the production mode in the next order is the double slotter mode. As a result, when the production mode in the next order is not the double slotter mode (step S103: NO), the control device 100 proceeds to step S112, and starts positioning for the next order, while keeping the single slotter mode. Specifically, the control device 100 sets the current register values (see FIG. 7) in the single slotter mode, according to the size information about the corrugated paperboard sheet in the next order, and, based on the set current register values, performs positioning control for the stationary blades and positioning control for the displaceable blades, respectively, by the differential positioning mechanisms 650A, 650B and the displaceable blade displacement adjustment mechanisms 660A, 660B.

On the other hand, when the production mode in the next order is the double slotter mode (step S103: YES), the control device 100 proceeds to step S104, and starts switching from the single slotter mode to the double slotter mode. Then, in step S105, the control device 100 performs the slotter blade-contact control for bringing the displaceable blade and the stationary blade into contact with each other.

With reference to FIG. 14, the slotter blade-contact control will be described. Upon start of the slotter blade-contact control, first of all, in step S201, in each of the first and second slotter units 61, 62, the control device 110 starts positioning of the stationary blade to the first reference position, and starts positioning of the displaceable blade to the second reference position. In this case, the control device 100 performs positioning control for the stationary blade and positioning control for the displaceable blade, respectively, by a corresponding one of the differential positioning mechanisms 650A, 650B and a corresponding one of the displaceable blade displacement adjustment mechanisms 660A, 660B.

Subsequently, upon completion of the positioning of the displaceable blade to the second reference position in step S202, the control device 100 determines, in step S203, whether or not the positioning of the stationary blade to the first reference position has been completed. As a result, when the positioning of the stationary blade to the first reference position has been completed (step S203: YES), the control device 100 proceeds to step S204, and starts to inch the displaceable blade toward the stationary blade by the corresponding one of the displaceable blade displacement adjustment mechanisms 660A, 660B. On the other hand, when the positioning of the stationary blade to the first reference position has not been completed (step S203: NO), the control device 100 returns to step S203, and re-performs the determination.

Subsequently, in step S205, the control device 100 determines whether or not a torque corresponding to a drive current of the phase adjustment motor 643 in the corresponding one of the displaceable blade displacement adjustment mechanisms 660A, 660B has exceeded a given threshold. In this example, based on a torque given from the phase adjustment motor 643 to the displaceable blade, the control device 100 determines whether or not the displaceable blade has been brought into contact with the stationary blade. As a result of the determination in the step S205, when the torque has exceeded the threshold (step S205: YES), i.e., when the displaceable blade has been brought into contact with the stationary blade, the control device 100 proceeds to step S206, and terminates the inching of the displaceable blade by the corresponding one of the displaceable blade displacement adjustment mechanisms 660A, 660B. Then, in step S207, the control device 100 stores the current register value of the displaceable blade being in contact with the stationary blade. On the other hand, when the torque has not exceeded the threshold (step S205: NO), i.e., when the displaceable blade has not been brought into contact with the stationary blade, the control device 100 returns to step S205, and re-performs the determination.

The control device 100 performs the above slotter blade-contact control on both of the first and second slotter units 61, 62.

Returning to FIG. 13, processing in and after step S106 will be described. After the slotter blade-contact control in the step S105, in the step S106, the control device 100 acquires respective current register values of the stationary blade and the displaceable blade being in a contact state. The current register value of the stationary blade acquired in this step is a value at the time when the stationary blade is located at the first reference position, and the current register value of the displaceable blade acquired in this step is a value stored in the step S207 in FIG. 14.

Subsequently, in step S107, the control device 100 derives the total blade length of the stationary blade and the displaceable blade, based on the current register values of the stationary blade and the displaceable blade, acquired in the step S106. Specifically, the control device 100 derives the total blade length of the stationary blade and the displaceable blade, by subtracting the current register value of the stationary blade and the current register value of the displaceable blade from the circumference of the upper slotter (slotter holder). Then, the control device 100 stores the total blade length derived in this manner. The control device 100 performs the calculation and storing of the total blade length, on both of the first and second slotter units 61, 62.

Subsequently, in step S108, the control device 100 derives, using the total blade length derived in the step S107, a correction constant for correcting the current register value of the stationary blade, i.e., a correction constant to be used for deriving a current register value to be displayed (hereinafter referred to as "display current register value"), from an actual value of the current register value of the stationary blade. Particularly, the control device 100 derives a correction constant for correcting the current register value of the first stationary blade 612, using the total blade length "f+g" of the first stationary blade 612 and the first displaceable blade 613 in the first slotter unit 61. Specifically, the control device 100 derives the correction constant by subtracting the total blade length "f+g" of the first stationary blade 612 and the first displaceable blade 613, from a length "$D\times\pi/2$" obtained by dividing the circumference of the upper slotter (slotter holder), i.e., by computing the following formula: "$(D\times\pi/2)-(f+g)$". Then, the control device 100 stores the correction constant derived in this manner.

Subsequently, in step S109, the control device 100 causes the display device 120 to display the current register values of the first and second stationary blades 612, 622 in the first and second slotter units 61, 62 to be set for performing slotting in the next order. Specifically, with regard to the second stationary blade 622, the control device 100 causes the display device 120 to directly display the actual current register value. On the other hand, with regard to the first stationary blade 612, the control device 100 causes the display device 120 to display, as a display current register value, a value obtained by correcting the actual current register value, using the correction constant obtained in the step S108. In this case, the control device 100 causes the display device 120 to display, as a display current register value of the first stationary blade 612, a value obtained by adding the correction constant to the actual current register value of the first stationary blade 612. Thus, with respect to the first stationary blade 612, a value obtained by adding the length dimension of the top flap portion and the box depth is displayed as a display current register value on the display device 120, and with respect to the second stationary blade 622, the length dimension of the top flap portion is displayed as a display current register value on the display device 120, Subsequently, in step S110, the control device 100 completes switching from the single slotter mode to the double slotter mode. Then, in step S111, the control device 100 performs positioning control for the next order.

With reference to FIG. 15, this positioning control will be described. Upon start of the positing control, first of all, in step S301, the control device 100 acquires a box size (i.e., processing size) of a corrugated paperboard sheet in the next order. Specifically, the control device 100 acquires a length dimension "a" of a top flap portion, a box depth dimension "b", and a length dimension "c" of a bottom flap portion in the corrugated paperboard sheet.

Subsequently, in step S302, the control device 100 derives the current register value to be set in the first slotter unit 61 in the double slotter mode, i.e., the current register value of the first stationary blade 612. Specifically, the control device 100 derives the current register value of the first stationary blade 612 by assigning the length dimension "a" of the top flap portion, the box depth dimension "b", the diameter D of the upper slotter (slotter holder) and the total blade length "f+g", to the formula "$a+b-\{(D\times\pi/2)-(f+g)\}$" (see FIG. 10).

Subsequently, in step S303, the control device 100 derives the current register value to be set in the second slotter unit 62 in the double slotter mode, i.e., the current register value of the second stationary blade 622. Specifically, the control device 100 sets the length dimension "a" of the top flap portion, as the current register value of the second stationary blade 612 (see FIG. 10).

Subsequently, in step S304, the control device 100 performs positioning control for the first slotter unit 61, based on the current register value derived in the step S302, and performs positioning control for the second slotter unit 62, based on the current register value derived in the step S303. Specifically, the control device 100 controls the differential adjustment motor of the differential positioning mechanism 650A, based on the current register value derived in the step S302, to integrally position the first stationary blade 612 and the first displaceable blade 613 being in the contact state, and controls the differential adjustment motor of the differential positioning mechanism 650B, based on the current register value derived in the step S303, to integrally position the second stationary blade 622 and the second displaceable blade 623 being in the contact state.

(Control for Switching from Double Slotter Mode to Single Slotter Mode)

Figure 17:
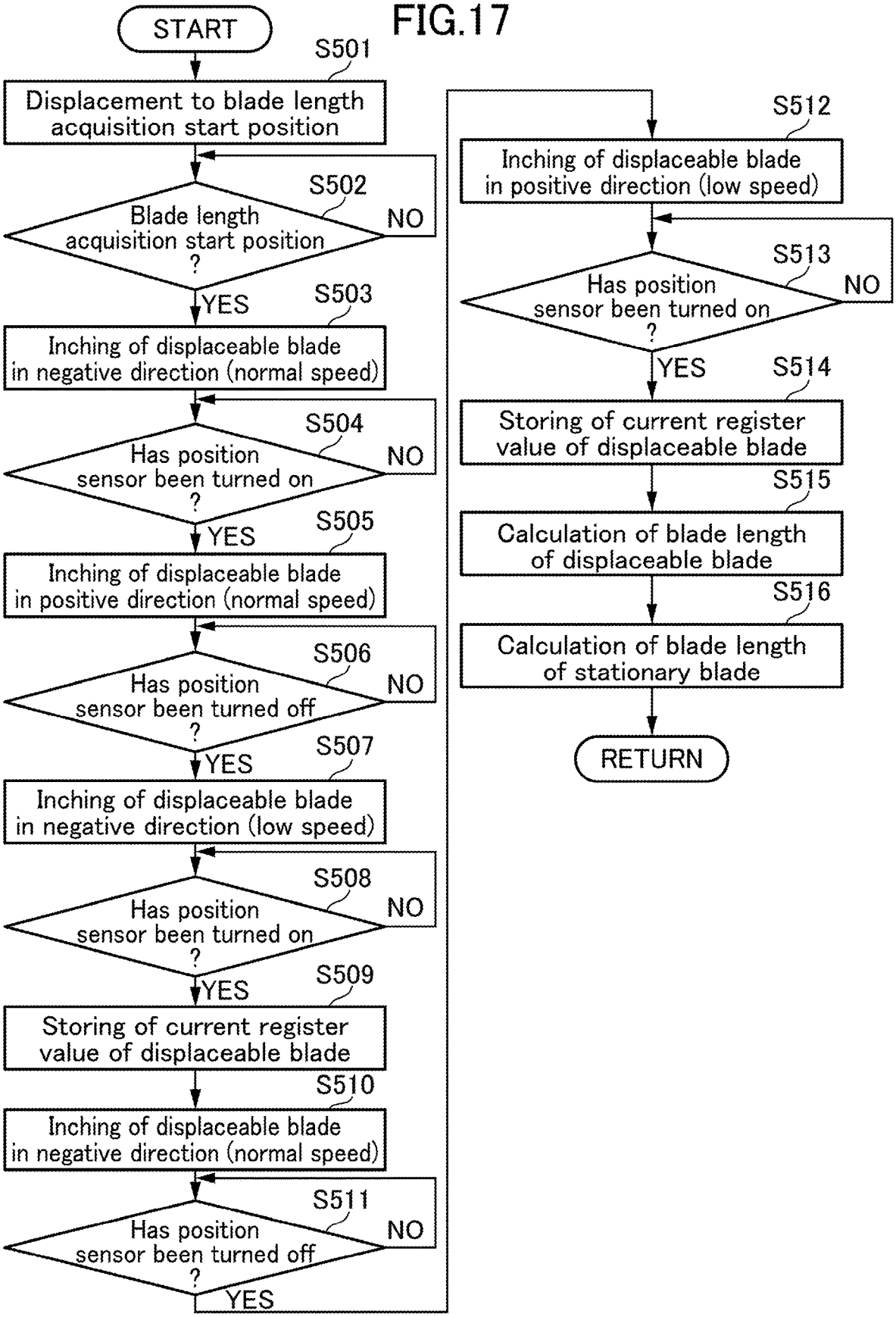
FIG. 17 is a flowchart presenting a first example of a blade length acquisition control, in this embodiment.
Figure 18:
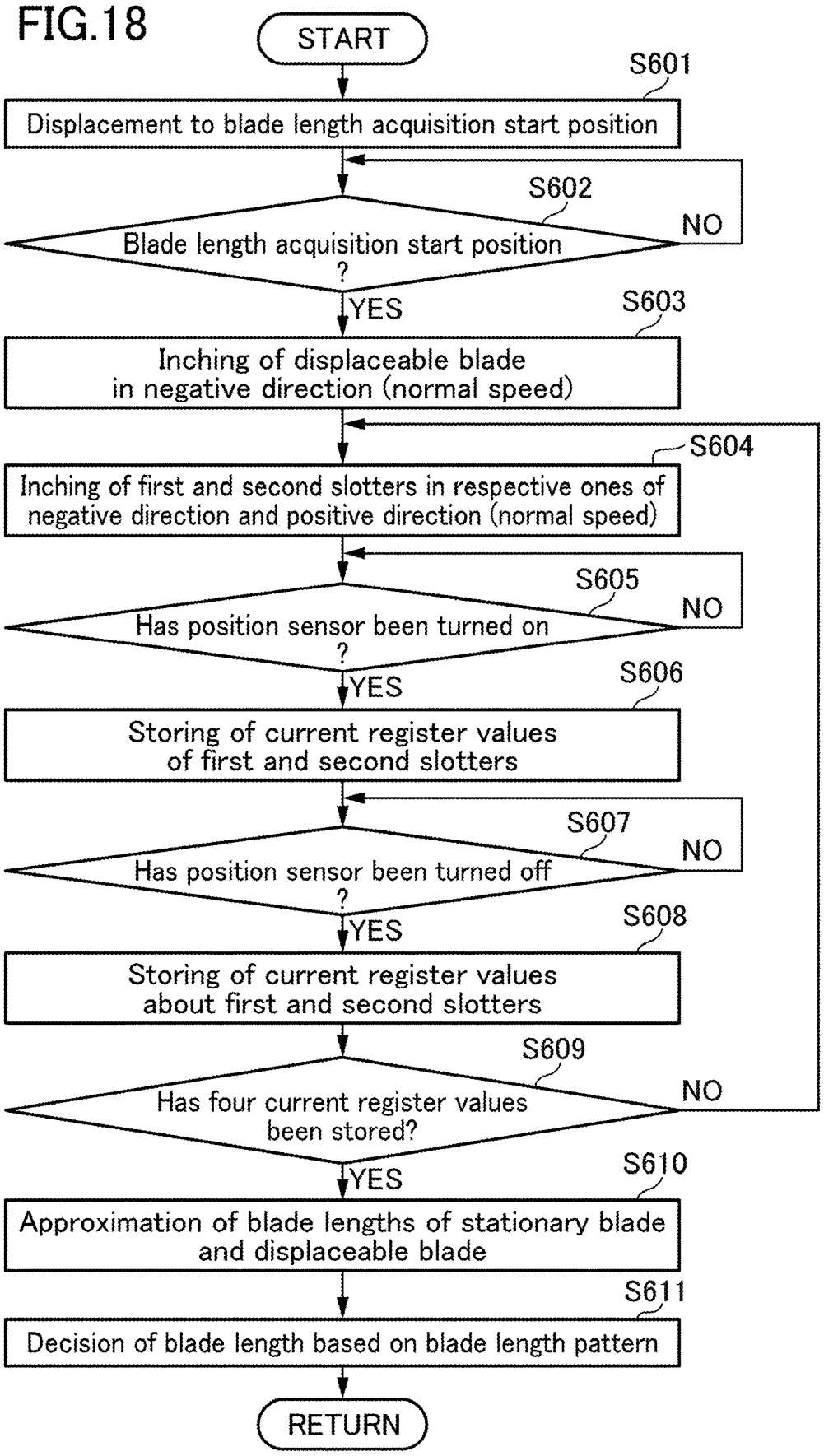
FIG. 18 is a flowchart presenting a second example of the blade length acquisition control, in this embodiment.
Figure 19A:
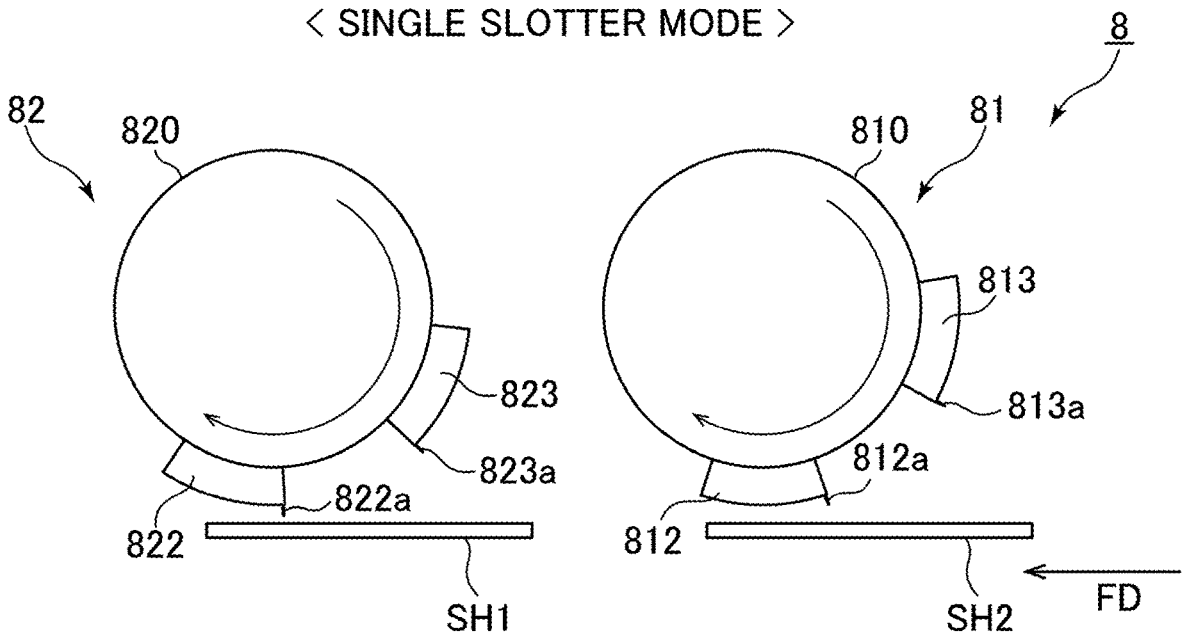
FIGS. 19A and 19B are explanatory diagrams of two production modes in a slotter device comprising first and second slotter units.
Figure 19B:
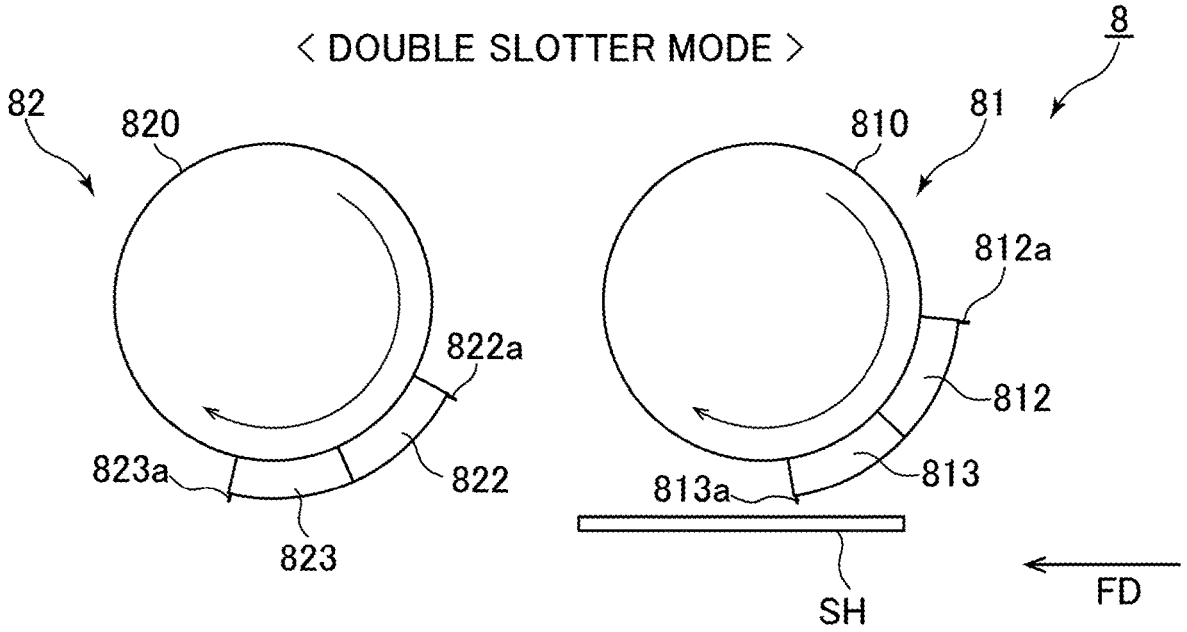

Next, with reference to FIG. 16 to FIG. 18, control for switching from the double slotter mode to the single slotter mode, in this embodiment, will be specifically described. FIG. 16 is a flowchart presenting the control for switching from the double slotter mode to the single slotter mode, in this embodiment. FIGS. 17 and 18 are flowcharts presenting a blade length acquisition control to be performed during the switching control. Specifically, FIG. 17 is a flowchart presenting a first example of the blade length acquisition control, in this embodiment, and FIG. 18 is a flowchart presenting a second example of the blade length acquisition control, in this embodiment. The following description will be made on an assumption that, at start of the flow in FIG. 16, the production mode of the slotter device 6 is set to the double slotter mode.

As depicted in FIG. 16, first of all, in step S401, the control device 100 starts initial mode setting about the slotter device 6. Then, in step S402, the control device 100 checks production mode to be set in a next order, and acquires size information (processing size) about a corrugated paperboard sheet to be subjected to slotting in the next order. For example, the control device 100 acquires production mode and size information input by an operator via the manipulation panel 110.

Subsequently, in step S403, the control device 100 determines whether or not the production mode in the next order is the single slotter mode. As a result, when the production mode in the next order is not the single slotter mode (step S403: NO), the control device 100 proceeds to step S412, and starts positioning for the next order, while keeping the double slotter mode. Specifically, the control device 100 sets the current register values (see FIG. 10) in the double slotter mode, according to the size information about the corrugated paperboard sheet in the next order, and, based on the set current register values, performs positioning control for the stationary blades by the differential positioning mechanisms 650A, 650B.

On the other hand, when the production mode in the next order is the single slotter mode (step S403: YES), the control device 100 proceeds to step S404, and starts switching from the double slotter mode to the single slotter mode.

Subsequently, in step S405, the control device 100 returns the current register values corrected for display in the double slotter mode, to the un-corrected current register values (individual current values) for the single slotter mode. Then, in step S406, the control device 100 executes a blade length acquisition control to acquire respective blade lengths of the slotter blades. Details of the blade length acquisition control will be described later.

Subsequently, the control device 100 compares, in step S407, the size information of the next order acquired in the step S402, with the blade lengths acquired in the step S406, and determines, in step S408, whether or not the corrugated paperboard sheet in the next order can be processed by the currently-employed slotter blades. Specifically, the control device 100 compares the blade length of the stationary blade with the length dimension of the top flap portion of the corrugated paperboard sheet, and compares the blade length of the displaceable blade with the length dimension of the bottom flap portion of the corrugated paperboard sheet. When the blade length of the stationary blade is greater than the length dimension of the top flap portion of the corrugated paperboard sheet, and the blade length of the displaceable blade is greater than the length dimension of the bottom flap portion of the corrugated paperboard sheet, the control device 100 determines that the corrugated paperboard sheet in the next order can be processed by the currently-employed slotter blades (step S408: YES). In this case, the control device 100 proceeds to step S409.

In the step S409, the control device 100 causes the display device 120 to display the current register values of the first and second stationary blades 612, 622 in the first and second slotter units 61, 62, to be set to perform slotting in the next order. Specifically, the control device 100 causes the display device 120 to display a value of the length dimension of the top flap portion of the corrugated paperboard sheet, as each of the current register values of the first and second stationary blades 612, 622.

Subsequently, in step S410, the control device 100 completes switching from the double slotter mode to the single slotter mode. Then, in step S411, the control device 100 performs positioning control for the next order. Specifically, the control device 100 sets the length dimension of the top flap portion of the corrugated paperboard sheet, as each of the current register values of the first and second stationary blades 612, 622, and control the differential adjustment motors of the differential positioning mechanisms 650A, 650B to perform the positioning control for the first and second stationary blades 612, 622, respectively. Further, the control device 100 sets the box depth dimension of the corrugated paperboard sheet, as each of the current register values of the first and second displaceable blades 613, 623, and control the displaceable blade displacement adjustment mechanisms 660A, 660B to perform the positioning control for the first and second displaceable blades 613, 623, respectively.

On the other hand, in the step S408, when the blade length of the stationary blade is less than the length dimension of the top flap portion of the corrugated paperboard sheet, or the blade length of the displaceable blade is less than the length dimension of the bottom flap portion of the corrugated paperboard sheet, the control device 100 determines that the corrugated paperboard sheet in the next order cannot be processed by the currently-employed slotter blades (step S408: NO). In this case, the control device 100 proceeds to step S413.

In the step S413, the control device 100 causes the display device 120 to display an alarm indicating that it is necessary to attach a joint blade to each of the slotter blades. Then, in step S414, the control device 100 causes the upper slotter to be positioned to allow a yoke to face a given joint blade-attaching position. That is, the control device 100 causes the upper slotter to be moved to a position for easy attachment of a joint blade, along the axial direction of the slotter shaft. Then, after an operator completes a joint blade-attaching operation, in step S415, the control device 100 acquires the blade lengths of the slotter blades from an input value input by an operator through the manipulation panel 110, or executes the blade length acquisition control to acquire the blade lengths of the slotter blades, in the same manner as that in the step S406. Then, the control device 100 returns to the step S407, and re-performs the above processing in and after the step S407.

Next, with reference to FIG. 17, a first example of the blade length acquisition control in this embodiment will be described. The first example of the blade length acquisition control is executed in the step S406 in FIG. 16.

First of all, in step S501, the control device 100 controls each of the differential adjustment motors of the differential positioning mechanisms 650A, 650B to displace the set of slotter blades (set of the stationary blade and the displaceable blade) to a given blade length acquisition start position. As this blade length acquisition start position, a position is used which is free from interference between the set of slotter blades of the first slotter unit 61 and the set of slotter blades of the second slotter unit 62. Typically, as the blade length acquisition start position in the first slotter unit 61, a position on the outer periphery of the first upper slotter 610 is used, wherein the position is located on a side opposite to the second upper slotter 620 (i.e. located farther away from the second upper slotter 620, and, as the blade length acquisition start position in the second slotter unit 62, a position on the outer periphery of the second upper slotter 620 is used, wherein the position is located on a side opposite to the first upper slotter 610 (i.e. located farther away from the first upper slotter 610).

Subsequently, in step S502, the control device 100 determines whether or not the set of slotter blades has been disposed at the blade length acquisition start position. As a result, when the set of slotter blades has been disposed at the blade length acquisition start position (step S502: YES), the control device 100 proceeds to step S503. On the other hand, when the set of slotter blades has not been disposed at the blade length acquisition start position (step S502: NO), the control device 100 returns to step S502, and re-performs the determination.

In the step S503, the control device 100 controls each of the displaceable blade displacement adjustment mechanisms 660A, 660B to inch the displaceable blade in a negative direction (counterclockwise direction) in the upper slotter, at a given normal speed (which is a speed generally used when displacing the displaceable blade using each of the displaceable blade displacement adjustment mechanisms 660A, 660B, and is a relatively high speed. This will be also applied to the following). Then, in step S504, the control device 100 determines whether or not the position sensor (671, 672) has been turned on, i.e., whether or not the displaceable blade has been detected by the position sensor (671, 672). As a result, when the position sensor (671, 672) has been turned on (step S504: YES), the control device 100 proceeds to step S505. In the above steps S503, S504, the control device 100 is configured to cause the displaceable blade to be inched at the normal speed, so that the position of one, first, edge of the displaceable blade located on a leading side in the negative direction is roughly detected by the position sensor (671, 672) in a quick manner. On the other hand, when the position sensor (671, 672) has not been turned on (step S504: NO), the control device 100 returns to step S504, and re-performs the determination.

In the step S505, the control device 100 disables the displacement of the displaceable blade in the negative direction, and causes the displaceable blade to be inched in a positive direction (clockwise direction) in the upper slotter, at the normal speed. Then, in step S506, the control device 100 determines whether or not the position sensor (671, 672) has been turned off, i.e., whether or not the displaceable blade has ceased to be detected by the position sensor (671, 672). As a result, when the position sensor (671, 672) has been turned off (step S506: YES), the control device 100 proceeds to step S507. In the above steps S505, S506, the control device 100 causes the displaceable blade to be returned to a position where it is not detected by the position sensor (671, 672), once. On the other hand, when the position sensor (671, 672) has not been turned off (step S506: NO), the control device 100 returns to step S506, and re-performs the determination.

In the step S507, the control device 100 controls each of the displaceable blade displacement adjustment mechanisms 660A, 660B to inch the displaceable blade in the negative direction at a low speed (which is a speed sufficiently slower than the normal speed. This will be also applied to the following). Then, step S508, the control device 100 determines whether or not the position sensor (671, 672) has been turned on. As a result, when the position sensor (671, 672) has been turned on (step S508: YES), the control device 100 proceeds to step S509. In the above steps S507, S508, the control device 100 is configured to cause the displaceable blade to be inched at the low speed, so that the position of the first edge of the displaceable blade located on the leading side in the negative direction is accurately detected by the position sensor (671, 672). On the other hand, when the position sensor (671, 672) has not been turned on (step S508: NO), the control device 100 returns to step S508, and re-performs the determination.

In the step S509, the control device 100 stores the current register value of the displaceable blade at the time when the position sensor (671, 672) has been turned on in the step S508. That is, the control device 100 stores the current register value corresponding to the position of the first edge of the displaceable blade located on the leading side in the negative direction.

Subsequently, in step 510, the control device 100 controls each of the displaceable blade displacement adjustment mechanisms 660A, 660B to inch the displaceable blade in the negative direction at the normal speed. In this step, the control device 100 causes the displaceable blade to be further displaced in the negative direction so as to pass through the position sensor (671, 672) (when the displaceable blade is passing through the position sensor (671, 672), the position sensor (671, 672) is maintained in an ON state). Then, step S511, the control device 100 determines whether or not the position sensor (671, 672) has been turned off. As a result, when the position sensor (671, 672) has been turned off (step S511: YES), the control device 100 proceeds to step S512. In the above steps S510, S511, the control device 100 is configured to cause the displaceable blade to be inched at the normal speed, so that the position of the other, second, edge of the displaceable blade located on a leading side in the positive direction is roughly detected by the position sensor (671, 672) in a quick manner. On the other hand, when the position sensor (671, 672) has not been turned off (step S511: NO), the control device 100 returns to step S511, and re-performs the determination.

In the step S512, the control device 100 controls each of the displaceable blade displacement adjustment mechanisms 660A, 660B to inch the displaceable blade in the positive direction at the low speed. Then, in step S513, the control device 100 determines whether or not the position sensor (671, 672) has not been turned on. As a result, when the position sensor (671, 672) has been turned on (step S513: YES), the control device 100 proceeds to step S514. In the above steps S512, S513, the control device 100 is configured to cause the displaceable blade to be inched at the low speed, so that the position of the second edge of the displaceable blade located on the leading side in the positive direction is accurately detected by the position sensor (671, 672). On the other hand, when the position sensor (671, 672) has not been turned on (step S513: NO), the control device 100 returns to step S513, and re-performs the determination.

In the step S514, the control device 100 stores the current register value of the displaceable blade at the time when the position sensor (671, 672) has been turned on in the step S513. That is, the control device 100 stores the current register value corresponding to the position of the second edge of the displaceable blade located on the leading side in the positive direction.

Subsequently, in step S515, the control device 100 derives the blade length of the displaceable blade by taking a difference between the current register value stored in the step S509 and the current register value stored in the step S514. This is equivalent to deriving the blade length of the displaceable blade from a relative difference between the position of the first edge of the displaceable blade located on the leading side in the negative direction and the position of the second edge of the displaceable blade located on the leading side in the positive direction.

Subsequently, in step S516, the control device 100 derives the blade length of the stationary blade by: acquiring the total blade length of the set of the stationary blade and the displaceable blade, which has been used in the double slotter mode before the blade length acquisition control, and subtracting the blade length of the displaceable blade derived in the step S515, from the acquired total blade length.

The control device 100 is configured to perform the first example of the blade length acquisition control depicted in FIG. 17, on both of the first and second slotter units 61, 62, to thereby derive respective blade lengths of the first and second stationary blades 612, 622 and the first and second displaceable blades 613, 623.

In the first example of the blade length acquisition control, the position of the displaceable blade is detected by the position sensor (671, 672) through the use of a combination of the displacement of the displaceable blade at the normal speed and the displacement of the displaceable blade at the low speed, so that it becomes possible to accurately derive the blade length in a relatively quick manner.

Next, with reference to FIG. 18, a second example of the blade length acquisition control in this embodiment will be described. The second example of the blade length acquisition control is executed in the step S406 in FIG. 16.

Basically, the second example of the blade length acquisition control is performed as substitute for the aforementioned first example of the blade length acquisition control. It is desirable to perform the second example of the blade length acquisition control, particularly, when the control device 100 stores a preliminarily-input blade length pattern. This blade length pattern includes blade lengths of various chisel-edged blades, blade lengths of various joint blades, and blade lengths of various slotter blades as combinations of the chisel-edged blades and the joint blades.

It is to be understood that the control device 100 may store both of a control program for the first example of the blade length acquisition control and a control program for the second example of the blade length acquisition control, and may be configured to selectively perform the first example of the blade length acquisition control and the second example of the blade length acquisition control.

Upon start of the second example of the blade length acquisition control, first of all, in step S601, the control device 100 controls each of the differential adjustment motors of the differential positioning mechanisms 650A, 650B to displace the set of slotter blade (set of the stationary blade and the displaceable blade) to a given blade length acquisition start position. As this blade length acquisition start position, the same position as that described in connection with the first example of the blade length acquisition control in FIG. 17 is used.

Subsequently, in step S602, the control device 100 determines whether or not the set of slotter blades has been disposed at the blade length acquisition start position. As a result, when the set of slotter blades has been disposed at the blade length acquisition start position (step S602: YES), the control device 100 proceeds to step S603. On the other hand, when the set of slotter blades has not been disposed at the blade length acquisition start position (step S602: NO), the control device 100 returns to step S602, and re-performs the determination.

Subsequently, in the step S603, the control device 100 controls each of the displaceable blade displacement adjustment mechanisms 660A, 660B to inch the displaceable blade in the negative direction at the normal speed by a given distance (e.g., 50 mm). That is, the control device 100 causes the displaceable blade to be spaced apart from the stationary blade by a given distance.

Subsequently, in step S604, the control device 100 controls the differential positioning mechanism 650A to inch the set of slotter blades (set of the stationary blade and the displaceable blade) of the first slotter unit 61 in the negative direction at the normal speed, and controls the differential positioning mechanism 650B to inch the set of slotter blades (set of the stationary blade and the displaceable blade) of the second slotter unit 62 in the positive direction at the normal speed.

Subsequently, in step S605, the control device 100 determines whether or not the position sensor (671, 672) has been turned on. As a result, when the position sensor (671, 672) has been turned on (step S605: YES), the control device 100 proceeds to step S606. In the above step S605, the control device 100 is configured to roughly detect the position of one, first, edge of one of the set of slotter blades consisting of the stationary blade and the displaceable blade, by the position sensor (671, 672) in a quick manner. On the other hand, when the position sensor (671, 672) has not been turned on (step S605: NO), the control device 100 returns to step S605, and re-performs the determination.

In the step S606, the control device 100 stores the current register value of the displaceable blade at the time when the position sensor (671, 672) has been turned on in the step S605. That is, the control device 100 stores the current register value corresponding to the position of the first edge of one of the set of slotter blades.

Subsequently, step S607, the control device 100 determines whether or not the position sensor (671, 672) has been turned off. As a result, when the position sensor (671, 672) has been turned off (step S607: YES), the control device 100 proceeds to step S608. In the above step S607, the control device 100 is configured to roughly detect the other, second, edge of the one of the set of slotter blades consisting of the stationary blade and the displaceable blade (edge of the one of the set of slotter blades on a side opposite to the first edge detected in the step S605) by the position sensor (671, 672) in a quick manner. On the other hand, when the position sensor (671, 672) has not been turned off (step S607: NO), the control device 100 returns to step S607, and re-performs the determination.

In the step S608, the control device 100 stores the current register value of the set of the slotter blades at the time when the position sensor (671, 672) has been turned off in the step S607. That is, the control device 100 stores the current register value corresponding to the position of the second edge of the one of the set of slotter blades.

Subsequently, in step S609, the control device 100 determines whether, with regard to each of the first and second slotter units 61, 62, four current register values have been stored through the above processing. That is, the control device 100 determines whether or not, with regard to each of the first and second slotter units 61, 62, two current register values corresponding to the positions of two opposite edges of each of the set of the stationary blade and the displaceable blade (total four current register values) have been stored. As a result, when four current register values have been stored (step S609: YES), the control device 100 proceeds to step S610. On the other hand, when four current register values have not been stored (step S609: NO), particularly when only two current register values have been stored, the control device 100 returns to step S604, and re-performs processing in and after the step S604. That is, the control device 100 operates to acquire and store the remaining two current register values.

In the step S610, the control device 100 derives the blade length of each of the slotter blades by taking a difference between the current register value stored in the step S606 and the current register value stored in the step S608. Specifically, the blade length of the stationary blade is derived by taking a difference between the current register value corresponding to one edge of the stationary blade and the current register value corresponding to the other edge of the stationary blade, and the blade length of the displaceable blade is derived by taking a difference between the current register value corresponding to one edge of the displaceable blade and the current register value corresponding to the other edge of the displaceable blade. In this case, the positions of the edges of each of the slotter blades are roughly detected as described above, so that the calculation of the blade length of the slotter blade is substantially rough calculation (i.e., there is a possibility that the blade length is not accurately derived).

Subsequently, in step S611, the control device 100 first acquires a blade length pattern preliminarily input and stored. In this step, the control device 100 acquires blade lengths of various chisel-edged blades, blade lengths of various joint blades, and blade lengths of various slotter blades as combinations of the chisel-edged blades and the joint blades. Then, the control device 100 decides respective blade lengths of the slotter blades, based on the acquired blade length pattern and the blade lengths roughly calculated in the step S610. Specifically, the control device 100 selects a blade length close to the blade length of each of the slotter blades roughly calculated in the step S610, from among the blade lengths included on the blade length pattern, and decides to use the selected blade length.

In the second example of the blade length acquisition control, the blade length roughly derived by displacing the slotter blade at the normal speed and the preliminarily-stored blade length pattern are used, so that it becomes possible to accurately derive the blade lengths in a quicker manner.

This technique of deriving blade length using such a blade length pattern may be employed when deriving the total blade length of the set of the stationary blade and the displaceable blade. That is, the blade length pattern may be configured to include total blade lengths, and, among the total blade lengths included in the blade length pattern, one close to the total blade length derived by the method described in the section "Control for Switching from Single Slotter Mode to Double Slotter Mode" may be selected and used.

<Functions/Effects>

Next, major functions/advantageous effects of the corrugated paperboard box making machine according to this embodiment will be described.

In this embodiment, when performing the double slotter mode, the total blade length of the set of the stationary blade and the displaceable blade can be derived. Thus, the use of such a total blade length makes is possible to adequately position the slotter blades, when performing the double slotter mode. Further, the total blade length of the set of the stationary blade and the displaceable blade can be automatically derived, so that it becomes possible to automatically switch from the single slotter mode to the double slotter mode.

In this embodiment, the displaceable blade is displaced toward and brought into contact with the stationary blade, and, in this actual contact state, the total blade length can be derived. Thus, even in a situation where there is a slight gap between the stationary blade and the displaceable blade in the contact state, it is possible to accurately calculate the total blade length while taking into account such a gap. Further, based on a torque given when displacing the displaceable blade, it is possible to accurately determine that the displaceable blade has been brought into contact with the stationary blade.

In this embodiment, the displaceable blade is brought into contact with the stationary blade in the lower region of the circumference of the cylinder (slotter holder) of the upper slotter. This makes it possible to prevent occurrence of defective contact between the slotter blades or damage to the displaceable blade displacement adjustment mechanism (660A, 660B) for displacing the slotter blade, which would otherwise be caused by foreign particles, such as paper fragment or paper powder, pinched between the slotter blades.

In this embodiment, it is possible to accurately derive the blade length of each of the slotter blades by using the position sensor (671, 672). Therefore, when switching from the double slotter mode to the single slotter mode, it is possible to adequately implement this first single slotter mode. In this case, the use of a preliminarily-stored blade length patter makes it possible to accurately derive the blade length in a quick manner.

In this embodiment, in the double slotter mode, with regard to the second stationary blade 622 of the second slotter unit 62, an actual value of the current register value thereof is directly displayed, whereas, with regard to the first stationary blade 612 of the first slotter unit 61, instead of directly displaying the actual current register value, the actual current register value is corrected to a value corresponding to the processing size of the corrugated paperboard sheet, and this corrected value is displayed. Thus, in the double slotter mode, with respect to each of the first and second stationary blades 612, 613, a value corresponding to the processing size of the corrugated paperboard sheet is displayed, so that an operator can easily perform various adjustments of the slotter device 6, under understanding of the relationship between the displayed value and the processing size of the corrugated paperboard sheet.

In this embodiment, it is possible to adequately correct the current register value to be displayed with regard to the first stationary blade 612, based, on the total blade length of the first stationary blade 621 and the first displaceable blade 613. In this case, the total blade length is derived in the aforementioned manner, so that it becomes possible to automatically perform the correction of the current register value based on the total blade length.

In this embodiment, a value obtained by the length of the top flap portion and the box depth of the corrugated paperboard sheet is displayed as the current display value of the first stationary blade 612, so that it is possible to enable an operator to reliably understand the relationship between the displayed value and the processing size of the corrugated paperboard sheet.

<Modifications>

Next, some modifications of the above embodiment will be described.

In the above embodiment, the total blade length of the set of the stationary blade and the displaceable blade is derived, based on respective current register values of the stationary blade and the displaceable blade at a time when the displaceable blade is displaced until it is brought into contact with the stationary blade. Alternatively, the total blade length may be derived using the position sensor (671, 672) in the same manner as that in the technique of deriving the blade lengths of the slotter blades (see FIGS. 17 and 18). For example, the total blade length may be derived by displacing the set of slotter blades brought into contact with each other and integrated together, in the vicinity of the position sensor (671, 672), and detecting opposite edges of the set of slotter blades by the position sensor (671, 672). This also makes it possible to accurately derive the total blade length.

In the above embodiment, the control device 100 is configured to derive the total blade length of the set of the stationary blade and the displaceable blade. Alternatively, in the case where an operator figures out the total blade length and has input the total blade length through the manipulation panel 110 or the like, the control device 100 may be configured to directly use the input total blade length without deriving the total blade length.

In the above embodiment, the value "a+b" obtained by adding the length of the top flap portion and the box depth of the corrugated paperboard sheet is displayed as the current register value of the first stationary blade. Alternatively, the box depth "b" of the corrugated paperboard sheet may be displayed as the current register value of the first stationary blade. In this case, "$(D\times\pi/2)-(f+g)-a$" may be used as a correction constant, and a value obtained by adding this correction constant to a value derived from "$a+b-\{(D\times\pi/2)-(f+g)\}$" may be displayed.

In the above embodiment, in the double slotter mode, with regard to the second stationary blade 622 of the second slotter unit 62, an actual value of the current register value thereof is directly displayed, whereas, with regard to the first stationary blade 612 of the first slotter unit 61, instead of directly displaying the actual current register value, the actual current register value is corrected to a value corresponding to the processing size of the corrugated paperboard sheet, and this corrected value is displayed. This processing is configured with a focus on a relationship between the current register value to be displayed and the processing size of the corrugated paperboard sheet.

Alternatively, the processing may be configured with a focus on a relationship between the current register value to be used in control (positioning control) and the processing size of the corrugated paperboard sheet. Specifically, in this modification, in the double slotter mode, with regard to the second stationary blade 622 of the second slotter unit 62, a value corresponding to the processing size of the corrugated paperboard sheet is directly used as the current register value thereof to perform the positioning control, whereas, with regard to the first stationary blade 612 of the first slotter unit 61, a value obtained by correcting the value corresponding to the processing size of the corrugated paperboard sheet is used as the current register value thereof to perform the positioning control. Specifically, with regard to the second stationary blade 622, the length "a" of the top flap portion of the corrugated paperboard sheet is used as the current register value thereof, whereas, with regard to the first stationary blade 612, a value obtained by correcting the value "a+b" derived from adding the length of the top flap portion and the box depth of the corrugated paperboard sheet is used as the current register value thereof. More specifically, a value obtained by subtracting the correction constant "$(D\times\pi/2)-(f+g)$" from the value "a+b" derived from adding the length of the top flap portion and the box depth, i.e., a value derived from the formula "$a+b-\{(D\times\pi/2)-(f+g)\}$", is used as the current register value of the first stationary blade 612. This modification makes it possible to adequately perform positioning control for the slotter blades in the double slotter mode.

What is claimed is:

1. A corrugated paperboard box making machine comprising a slotter device for performing slotting on a corrugated paperboard sheet, wherein the slotter device comprises a first slotter unit and a second slotter unit which is provided downstream of the first slotter unit in a conveyance direction of corrugated paperboard sheets, wherein:

the first slotter unit comprises: a first slotter which is a rotary cylinder rotatably coupled to a rotary shaft; a first stationary slotter blade fixed onto an outer periphery of the first slotter; a first displaceable slotter blade installed on the outer periphery of the first slotter displaceably in a circumferential direction of the first slotter; a first phase adjustment mechanism for rotating the first slotter so as to adjust a rotational phase of the first slotter; and a first displacement adjustment mechanism for displacing the first displaceable slotter blade so as to adjust a relative position of the first displaceable slotter blade with respect to the first stationary slotter blade, on the outer periphery of the first slotter; and the second slotter unit comprises: a second slotter which is a rotary cylinder rotatably coupled to a rotary shaft; a second stationary slotter blade fixed onto an outer periphery of the second slotter; a second displaceable slotter blade installed on the outer periphery of the second slotter displaceably in a circumferential direction of the second slotter; a second phase adjustment mechanism for rotating the second slotter so as to adjust a rotational phase of the second slotter; and a second displacement adjustment mechanism for displacing the second displaceable slotter blade so as to adjust a relative position of the second displaceable slotter blade with respect to the second stationary slotter blade, on the outer periphery of the second slotter, wherein the corrugated paperboard box making machine further comprises a control device configured to switchably implement a first production mode and a second production mode, wherein:

the first production mode is configured to feed two corrugated paperboard sheets during one revolution of the first and second slotters, and cause the first and second slotter units to perform slotting, respectively, on the two corrugated paperboard sheets, in such a state that the first stationary slotter blade and the first displaceable slotter blade are spaced apart from each other by a given distance on the outer periphery of the first slotter, and that the second stationary slotter blade and the second displaceable slotter blade are spaced apart from each other by a given distance on the outer periphery of the second slotter; and the second production mode is configured to feed one corrugated paperboard sheet during one revolution of the first and second slotters, and to cause both of the first and second slotter units to perform slotting on the one corrugated paperboard sheet, in such a state that the first stationary slotter blade and the first displaceable slotter blade are in contact with each other on the outer periphery of the first slotter, and that the second stationary slotter blade and the second displaceable slotter blade are in contact with each other on the outer periphery of the second slotter, and wherein the control device is configured:

to acquire a first total blade length of the first stationary slotter blade and the first displaceable slotter blade along the circumferential direction of the first slotter, and a second total blade length of the second stationary slotter blade and the second displaceable slotter blade along the circumferential direction of the second slotter, so as to store the acquired first and second total blade lengths when implementing the second production mode; and to perform positioning control for a set of the first stationary slotter blade and the first displaceable slotter blade being in a contact state by using the first phase adjustment mechanism, and perform positioning control for a set of the second stationary slotter blade and the second displaceable slotter blade being in a contact state by using the second phase adjustment mechanism, based on the stored first and second total blade lengths, in order to implement the second production mode.

2. The corrugated paperboard box making machine according to claim 1, wherein the control device is configured:

to cause the first displacement adjustment mechanism to displace the first displaceable slotter blade toward the first stationary slotter blade, from a state in which the first stationary slotter blade and the first displaceable slotter blade are disposed, respectively, at first and second reference positions spaced apart from each other on the outer periphery of the first slotter, so as to derive the first total blade length based on an amount by which the first displaceable slotter blade is displaced before it is brought into contact with the first stationary slotter blade; and to cause the second displacement adjustment mechanism to displace the second displaceable slotter blade toward the second stationary slotter blade, from a state in which the second stationary slotter blade and the second displaceable slotter blade are disposed, respectively, at third and fourth reference positions spaced apart from each other on the outer periphery of the second slotter, so as to derive the second total blade length based on an amount by which the second displaceable slotter blade is displaced before it is brought into contact with the second stationary slotter blade.

3. The corrugated paperboard box making machine according to claim 2, wherein the control device is configured:

to acquire a torque given from the first displacement adjustment mechanism to displace the first displaceable slotter blade, so as to determine whether or not the first displaceable slotter blade is brought into contact with the first stationary slotter blade, based on the acquired torque; and to acquire a torque given from the second displacement adjustment mechanism to displace the second displaceable slotter blade, so as to determine whether or not the second displaceable slotter blade is brought into contact with the second stationary slotter blade, based on the acquired torque.

4. The corrugated paperboard box making machine according to claim 2, wherein the first and second reference positions are defined in a lower region of a circumference of the first slotter, and the third and fourth reference positions are defined in a lower region of a circumference of the second slotter.

5. The corrugated paperboard box making machine according to claim 1, further comprising a first position sensor for detecting respective positions of the first stationary slotter blade and the first displaceable slotter blade on the outer periphery of the first slotter, and a second position sensor for detecting respective positions of the second stationary slotter blade and the second displaceable slotter blade on the outer periphery of the second slotter, wherein the control device is configured to derive the first total blade length based on a detection signal of the first position sensor, and to derive the second total blade length based on a detection signal of the second position sensor.

6. The corrugated paperboard box making machine according to claim 5, wherein the control device is further configured, when implementing the first production mode, to derive respective blade lengths of the first stationary slotter blade and the first displaceable slotter blade based on the detection signal of the first position sensor, and to derive respective blade lengths of the second stationary slotter blade and the second displaceable slotter blade based on the detection signal of the second position sensor.

7. The corrugated paperboard box making machine according to claim 1, wherein the control device is configured to acquire a blade length pattern of one of the slotter blades employed in the slotter device, so as to derive a blade length of the one of the slotter blades based on the acquired blade length pattern.

8. The corrugated paperboard box making machine according to claim 1, wherein the control device is configured to acquire and store the first and second total blade lengths which are input by an operator.

9. The corrugated paperboard box making machine according to claim 1, wherein the control device is configured, when implementing the second production mode, to control the first displacement adjustment mechanism to displace the first displaceable slotter blade so that the first stationary slotter blade and the first displaceable slotter blade are brought into contact with each other in a lower region of a circumference of the first slotter, and to control the second displacement adjustment mechanism to displace the second displaceable slotter blade so that the second stationary slotter blade and the second displaceable slotter blade are brought into contact with each other in a lower region of a circumference of the second slotter.

10. The corrugated paperboard box making machine according to claim 1, wherein the first stationary slotter blade is equipped with a chisel at an edge thereof on a leading side in a direction opposite to a rotational direction of the first slotter during processing of corrugated paperboard sheets, wherein the first displaceable slotter blade is equipped with a chisel at an edge thereof on a leading side in the rotational direction of the first slotter during the processing of corrugated paperboard sheets, wherein the second stationary slotter blade is equipped with a chisel at an edge thereof on a leading side in a direction opposite to a rotational direction of the second slotter during the processing of corrugated paperboard sheets, wherein the second displaceable slotter blade is equipped with a chisel at an edge thereof on a leading side in the rotational direction of the second slotter during the processing of corrugated paperboard sheets, wherein the corrugated paperboard box making machine further comprises a display device for displaying given information based on control of the control device, wherein the control device is configured:

to perform positioning control for the first stationary slotter blade by using a first positioning parameter indicative of a relative position at which the chisel of the first stationary slotter blade of the first slotter unit is to be disposed with respect to a downstream edge of the corrugated paperboard sheet, in order to cause the first slotter unit to perform slotting on the corrugated paperboard sheet; and to perform positioning control for the second stationary slotter blade by using a second positioning parameter indicative of a relative position at which the chisel of the second stationary slotter blade of the second slotter unit is to be disposed with respect to a downstream edge of the corrugated paperboard sheet, in order to cause the second slotter unit to perform slotting on the corrugated paperboard sheet;

and wherein, when implementing the second production mode, the control device is configured:

with regard to the second positioning parameter, to cause the display device to directly display a value corresponding to the second positioning parameter; and with regard to the first positioning parameter, to correct a value corresponding to the first positioning parameter into a value corresponding to a size of the corrugated paperboard sheet, so as to cause the display device to display the corrected value.

11. The corrugated paperboard box making machine according to claim 10, wherein the control device is configured to correct the first positioning parameter based on the first total blade length of the first stationary slotter blade and the first displaceable slotter blade along the circumferential direction of the first slotter.

12. The corrugated paperboard box making machine according to claim 11, wherein the control device is configured, when switching from the first production mode to the second production mode, to acquire and store the first total blade length, and to correct the first positioning parameter based on the stored first total blade length.

13. The corrugated paperboard box making machine according to claim 10, wherein the control device is configured to correct the first positioning parameter by adding, to the value corresponding to the first positioning parameter, a value derived from the following formula: $[(D\times\pi/2)-(f+g)]$, where: "D" denotes a diameter of the first slotter; "f" denotes a blade length of the first stationary slotter blade; and "g" denotes a blade length of the first displaceable slotter blade.

14. The corrugated paperboard box making machine according to claim 10, wherein the control device is configured to cause the display device to display a value of (a+b), as a corrected value of the value corresponding to the first positioning parameter, where "a" and "b" denote, respectively, a length of a top flap and a box depth of the corrugated paperboard sheet.

15. The corrugated paperboard box making machine according to claim 10, wherein the control device is configured to cause the display device to display a value of "b", as a corrected value of the value corresponding to the first positioning parameter, where "b" denotes a box depth of the corrugated paperboard sheet.

16. The corrugated paperboard box making machine according to claim 10, wherein the control device is further configured to perform positioning control for the first displaceable slotter blade by using a third positioning parameter indicative of a relative position at which the chisel of the first displaceable slotter blade of the first slotter unit is to be disposed with respect to the chisel of the first stationary slotter blade, and to perform positioning control for the second displaceable slotter blade by using a fourth positioning parameter indicative of a relative position at which the chisel of the second displaceable slotter blade of the second slotter unit is to be disposed with respect to the chisel of the second stationary slotter blade.

17. The corrugated paperboard box making machine according to claim 1, wherein the first stationary slotter blade is equipped with a chisel at an edge thereof on a leading side in a direction opposite to a rotational direction of the first slotter during processing of corrugated paperboard sheets, wherein the first displaceable slotter blade is equipped with a chisel at an edge thereof on a leading side in the rotational direction of the first slotter during the processing of corrugated paperboard sheets, wherein the second stationary slotter blade is equipped with a chisel at an edge thereof on a leading side in a direction opposite to a rotational direction of the second slotter during the processing of corrugated paperboard sheets, wherein the second displaceable slotter blade is equipped with a chisel at an edge thereof on a leading side in the rotational direction of the second slotter during the processing of corrugated paperboard sheets, wherein the control device is configured:

to perform positioning control for the first stationary slotter blade by using a first positioning parameter indicative of a relative position at which the chisel of the first stationary slotter blade of the first slotter unit is to be disposed with respect to a downstream edge of the corrugated paperboard sheet, in order to cause the first slotter unit to perform slotting on the corrugated paperboard sheet; and to perform positioning control for the second stationary slotter blade by using a second positioning parameter indicative of a relative position at which the chisel of the second stationary slotter blade of the second slotter unit is to be disposed with respect to a downstream edge of the corrugated paperboard sheet, in order to cause the second slotter unit to perform slotting on the corrugated paperboard sheet;

and wherein, when implementing the second production mode, the control device is configured:

with regard to the second positioning parameter, to directly use a value corresponding to a size of the corrugated paperboard sheet; and with regard to the first positioning parameter, to use a value obtained by correcting the value corresponding to the size of the corrugated paperboard sheet.

* * * * *